US008015777B2

(12) United States Patent
Yagyu et al.

(10) Patent No.: US 8,015,777 B2
(45) Date of Patent: Sep. 13, 2011

(54) METHOD FOR FILLING CAPSULE BODY WITH TABLET AND DEVICE FOR FILLING CAPSULE WITH TABLET BY USING THAT FILLING METHOD

(75) Inventors: Motohiro Yagyu, Yamatokoriyama (JP); Ryota Kurimoto, Yamatokoriyama (JP); Hideo Okamoto, Yamatokoriyama (JP); Tetsuhisa Ishida, Yamatokoriyama (JP)

(73) Assignee: Qualicaps Co., Ltd., Yamatokoriyama-shi (JP)

( * ) Notice: Subject to any disclaimer, the term of this patent is extended or adjusted under 35 U.S.C. 154(b) by 99 days.

(21) Appl. No.: 12/300,727

(22) PCT Filed: May 8, 2007

(86) PCT No.: PCT/JP2007/059497

§ 371 (c)(1),
(2), (4) Date: Nov. 13, 2008

(87) PCT Pub. No.: WO2007/132697

PCT Pub. Date: Nov. 22, 2007

(65) Prior Publication Data

US 2009/0241482 A1 Oct. 1, 2009

(30) Foreign Application Priority Data

May 16, 2006 (JP) ..... 2006-136819

(51) Int. Cl.
*B65B 35/50* (2006.01)

(52) U.S. Cl. ..... 53/447; 53/443; 53/475; 53/152; 53/532; 53/540; 53/247

(58) Field of Classification Search ..... 53/447, 53/443, 473, 475, 147, 152, 531, 532, 540, 53/247, 254

See application file for complete search history.

(56) References Cited

U.S. PATENT DOCUMENTS

| | | | | |
|---|---|---|---|---|
| 3,347,016 | A * | 10/1967 | Silverman | 53/246 |
| 3,641,735 | A * | 2/1972 | Daily et al. | 53/537 |
| 5,279,096 | A * | 1/1994 | Mims | 53/447 |
| 5,329,749 | A | 7/1994 | Yamamoto et al. | |
| 5,682,733 | A * | 11/1997 | Perrone | 53/560 |
| 6,438,925 | B1 * | 8/2002 | Straub | 53/244 |

FOREIGN PATENT DOCUMENTS

| | | | |
|---|---|---|---|
| JP | 5-170201 | A | 7/1993 |
| JP | 8-34401 | A | 2/1996 |

* cited by examiner

*Primary Examiner* — Christopher Harmon
(74) *Attorney, Agent, or Firm* — Birch, Stewart, Kolasch & Birch, LLP

(57) ABSTRACT

A plurality of flat tablets are held in containing holes (211) by pinching the circumferential edge of the flat tablet (t) at the lowermost position at the lower end of the containing hole, and then pinching state of the tablet (t) at the lowermost position is released thus dropping the plurality of flat tablets (t) under a flat state into a capsule body (m) arranged below. The capsule body can be surely filled with a predetermined number of flat tablets under a flat state by preventing occurrence of flat tablets under a standing state effectively.

12 Claims, 20 Drawing Sheets

153
12b
142
146
141
14
t
147
143
t
144
145
131
13
132
11
t
111
114
112
113

(A)

(B)

(A)

(B)

(A)

(B)

METHOD FOR FILLING CAPSULE BODY WITH TABLET AND DEVICE FOR FILLING CAPSULE WITH TABLET BY USING THAT FILLING METHOD

TECHNICAL FIELD

The present invention relates to a method for filling a capsule body with a predetermined number of tablets having a flat shape (hereinafter referred to as "the flat tablets") under a flat state, and a device for filling capsule with tablet for filling a capsule body with the flat tablets by using the filling method.

BACKGROUND ART

In a capsulated drug in which a hard capsule consisting of a cap and a body is filled with a drug, generally, the drug filling the capsule is powdery, granular or liquid. In some practical cases, however, a capsule consisting of a cap and a body is filled with a predetermined number of tablets, to produce a tablet-filled capsulated drug.

Specifically, in some cases of drugs, the dose for one-time medication has normally to be changed according to the patient's symptom, age or other conditions. In such a case, when the drug is supplied in the form of tablets having a predetermined unit quantity, it is easy to change the number of tablets for dosage according to the patient. However, there may arise an inconvenience. Where the dose is controlled in terms of the number of tablets for dosage, the patient must count the tablets at the time of dosage for the purpose of taking the tablets in the number according to the patient's symptom and/or age, which is troublesome. In addition, it may be necessary for some patients to take a very large number of tablets at a time. In view of this problem, a capsulated drug may be produced preliminarily by filling a capsule with tablets, each containing a predetermined unit quantity of an active ingredient or ingredients, in the number according to the patient's age and/or symptom, and put to medication, whereby the burden on the patient at the time of medication can be alleviated. In the case of a combined dosage of a plurality of kinds of drugs, a single capsule may be filled with the plurality of kinds of drugs according to the disease and/or symptom, etc., whereby multi-component drugs according to a plurality of kinds of diseases and/or symptoms, etc. can be prepared as capsulated drugs.

Here, while a capsulated drug filled with a powdery or granular drug is produced by automatically filling each of capsules with the powdery or granular drug by a capsule filling machine, an automatic tablet filling machine for filling each of capsules with tablets in a similar manner has also been proposed. In this case, in order to make the capsulated drug as small as possible in size for the purpose of alleviating the burden on the patient at the time of medication, filling a capsule with ordinary flat tablets is carried out by a method in which the capsule is filled with the plurality of flat tablets under a flat state.

Herein, the expression "the flat tablet under a flat state" means the state of the flat tablet having its radial direction set horizontal (in the transverse direction) and its thickness direction set in the vertical direction (the longitudinal direction). On the other hand, the expression "the flat tablet under a standing state" appearing later means the state of the flat tablet having its radial direction set in the vertical direction (the longitudinal direction) or set inclined.

Specific examples of the filling machine for filling a capsule with flat tablets include a tablet filling apparatus disclosed in JP-A 5-170201 (Patent Document 1). In the tablet filling apparatus, as shown in FIG. 20(A), tablets (t) are supplied from a tablet supply hopper (not shown) into first guide holes (b) in a first tablet guide chute (a) to contain the tablet (t) in a row in each first guide hole (b), and the lowermost one of the tablets (t) thus contained in each first guide hole (b) is contained in each counting hole (d) in a counting plate (c). Next, as shown in FIG. 20(B), the counting plate (c) is slid so that the tablets (t) in the counting holes (d) are fed into tablet holding holes (f) in a tablet holding block (e) which are arranged to be displaced from the first guide holes (b) in the first tablet guide chute (a). This reciprocal sliding motion of the counting plate (c) is repeated a predetermined number of times, whereby the predetermined number of the tablets (t) are contained into and held in each of the tablet holding holes (f). Then, as shown in FIG. 20(C), a shutter plate (g) arranged under the tablet holding block (e) is moved to coincide insertion holes (h) in the shutter plate (g) with the tablet holding holes (f), whereby the lower end surfaces of the tablet holding holes (f) are opened. As a result, the tablets (t) contained in each of the tablet holding holes (f) are passed through each second guide hole (j) in a second tablet guide chute (i), to be fed into each capsule body (m) held in a capsule holding block (k) which is arranged on the lower side of the second guide chute (i). In this manner, each capsule body (m) is filled with the predetermined number of tablets (t).

However, in the case of filling a capsule body with flat tablets by use of this filling machine according to the related art, it is highly possible that the flat tablet fed into the capsule body may come into a standing state, to make it impossible to feed the predetermined number of tablets into the capsule body.

More specifically, the filling machine is so configured that, when the flat tablets (t) are dropped from each tablet holding hole (f) in the tablet holding block (e) into each capsule body (m) held in the capsule holding block (k), the shutter plate (g) is slid so as to open the lower end surface of each tablet holding hole (f). Therefore, the lower end surface of the tablet holding hole (f) is gradually opened from one lateral side. Accordingly, the flat tablet contained in a lowermost part of the tablet holding hole (f) under a flat state may fall in the manner of rolling down while becoming inclined from one lateral side, resulting in that the flat tablet (t) drops into the capsule body (m) under a standing state, i.e., with its radial direction set vertical (longitudinal) or inclined. Thus, the flat tablet (t) under a standing state may be generated in the capsule body (m). Besides, the friction at the time of sliding of the shutter plate (g) may also cause the tablet in the lowermost part of the tablet holding hole (f) to come into a standing state.

Furthermore, when the tablet (t) drops from the tablet holding hole (f) into the capsule body (m) held in the capsule holding block (k), a part of the tablet (t) may make contact with the inner circumferential surface of the hole or with an opening edge of the capsule body (m) which is stepped in relation to the inner circumferential surface, resulting in that the tablet (t) is rotated into a standing state.

If a tablet under a standing state is thus generated in the capsule body (m), the tablet in the standing state would occupy a large space in the vertical (longitudinal) direction in the capsule body (m), making it impossible to contain a predetermined number of tablets (t) into the capsule body (m). In addition, the tablet having failed to be contained into the capsule body (m) and protruding from the capsule holding block (k) may plug up the passage for the tablets, causing the succeeding flat tablets to be blocked in series. In such a situation, the tablets may be broken by the motion of the shutter plate (g), possibly leading to a serious trouble in which the fine chips generated upon the breakage clog up various parts of the system.

Patent Document 1: JP-A 5-170201

DISCLOSURE OF INVENTION

Problems to be Solved by the Invention

The present invention has been made in consideration of the above-mentioned circumstances. Accordingly, it is an object of the present invention to provide a method for filling capsule with tablet, and a device for filling capsule with tablet by using the filling method, by which, at the time of filling a capsule body with a predetermined number of flat tablets under a flat state, the inconvenience of the flat tablets coming into a standing state can be prevented as securely as possible and the operation of filling the capsule body with the flat tablets can be carried out assuredly and stably.

Means for Solving the Problems

In order to attain the above object, according to the present invention, there is provided a method for filling capsule body with tablet, by which a predetermined number of flat tablets aligned and stacked along the vertical direction while being each kept in a flat state are dropped into a capsule body arranged below so as to fill the capsule body with the predetermined number of flat tablets, wherein the predetermined number of flat tablets under a flat state are contained in a containing hole with their axes set along the vertical direction, in the state of being stacked coaxially, and a circumferential edge part of the flat tablet at a lowermost position is supported by tablet supporting means disposed at a lower end part of the containing hole, whereby the flat tablets are contained in the containing hole in the flat stacked state, then, in this condition, the capsule body is arranged just under the containing hole and the supporting of the lowermost-position tablet by the tablet holding means is released, whereby a flat tablet group included of the plurality of flat tablets stacked under the flat state is dropped from the containing hole into the capsule body.

In addition, according to the present invention, there is provided a device for filling a capsule with flat tablets by using the tablet filling method according to the present invention. Specifically, according to the present invention, there is provided a device for filling capsule with tablet, by which a predetermined number of flat tablets are aligned and stacked along the vertical direction while being each kept under a flat state and a capsule body is filled with the predetermined number of flat tablets fed into the capsule body, wherein the device includes: a containing hole having an axis along the vertical direction and operative to contain a flat tablet group which includes the predetermined number of flat tablets stacked along the vertical direction while being each kept under a flat state; a tablet supplying mechanism unit for supplying the predetermined number of flat tablets into the containing hole so as to form the flat tablet group in the containing hole; tablet holding means for supporting a circumferential edge part of the lowermost-position tablet in the flat tablet group; and a capsule body arranging mechanism unit for arranging the capsule body just under the containing hole, and wherein the supporting of the lowermost-position tablet in the flat tablet group by the tablet holding means is released, thereby dropping the flat tablet group from the containing hole into the capsule body.

Thus, according to the tablet filling method of the present invention, as above-mentioned, a predetermined number of flat tablets are contained in the containing hole under a flat state to form in the containing hole the flat tablet group including the predetermined number of flat tablets stacked under the flat state, the flat tablet group is held in the containing hole by supporting a circumferential edge part of the tablet at the lowermost position in the flat tablet group, for example, by pinching the circumferential edge part of the tablet by tablet holding means, then, in this condition, the capsule body is arranged just under the containing hole, and the supporting of the lowermost-position tablet in the flat tablet group by the tablet holding means is released, whereby the flat tablet group is dropped and discharged from the lower surface of the containing hole into the capsule body.

In addition, in the tablet filling device according to the present invention, the flat tablets are supplied into the containing hole by the tablet supplying mechanism unit so as to form in the containing hole the flat tablet group including the predetermined number of flat tablets stacked under the flat state, the tablet at the lowermost position in the flat tablet group is supported by the tablet holding means so as to once hold the flat tablet group in the containing hole, the capsule body is arranged just under the containing hole by the capsule body arranging mechanism unit, and the supporting of the lowermost-position tablet by the tablet holding means is released, whereby the flat tablet group is dropped and discharged from the lower end surface of the containing hole into the capsule body.

Thus, in the present invention, the flat tablet group is held in the containing hole by supporting a circumferential edge part of the tablet at the lowermost position in the flat tablet group, for example, by pinching the circumferential edge part of the tablet by the tablet holding means provided at the lower end part of the containing hole, and the supporting of the circumferential edge part of the lowermost-position tablet by the tablet holding means is released, thereby dropping the flat tablet group into the capsule body. Therefore, an opening operation in which the lower end surface of a hole-shaped containing section containing flat tablets therein is gradually opened from one lateral side, as in the case of a conventional apparatus wherein the lower end surface is opened and closed with a shutter plate put into sliding motions, is not adopted here. Instead, the supporting of the flat tablet held by supporting the circumferential edge part thereof, for example, by pinching the circumferential edge part, is released at a stroke to thereby release the holding condition; accordingly, not any rotating force is exerted on the tablet at the lowermost position. Besides, a rotating force due to friction, such as those exerted at the time of opening and closing of a shutter plate, is not exerted on the lowermost-position tablet. Consequently, the holding of the flat tablet can be released securely while keeping the flat state, thereby dropping the flat tablets into the capsule body as they are in the flat state.

Besides, as preferred embodiments of the present invention, there are provided:

a method for filling capsule body with tablet as set forth in claim 1, wherein a filling-time tablet presser pin is brought from above into contact with the uppermost-position tablet in the flat tablet group contained in the containing hole so as to press the flat tablet group downward with a predetermined force, then, in this condition, the supporting of the lowermost-position tablet by the tablet holding means is released so that the flat tablet group drops together with the filling-time tablet presser pin and that the flat tablet group drops into the capsule body while being pressed from above by the filling-time tablet presser pin, whereby the capsule body is filled with the flat tablets while the flat state of each of the flat tablets constituting the flat tablet group is kept by the presser pin; and a device for filling capsule with tablet according to the present invention as above-mentioned, wherein the device includes a filling-time tablet presser pin which enters the containing hole from above to come into contact with the uppermost-position tablet in the flat tablet group contained in the containing hole, presses the flat tablet group downwards with a predetermined pressure, and falls together with the flat tablet group when the flat tablet group is dropped into the capsule body.

Specifically, in the filling method and the filling device according to the embodiments, at the time when the flat tablet group contained in the containing hole is dropped into the capsule body, the filling-time tablet presser pin disposed to be vertically movable is brought from above into contact with the tablet at the uppermost position in the flat tablet group, and, while pressing the flat tablet group downward with a predetermined force by the filling-time tablet presser pin, the flat tablet group is dropped together with the filling-time tablet presser pin into the capsule body.

Therefore, the flat tablet group falling from the containing hole into the capsule body below falls into the capsule body while being pressed from above by the filling-time tablet presser pin. As a result, the flat tablet group is dropped into the capsule body while the flat state of each of the flat tablets constituting the flat tablet group is being favorably maintained by the filling-time tablet presser pin. Accordingly, even if a circumferential edge part of the flat tablet comes into contact with the inner circumferential surface of the containing hole or with the upper end edge of the capsule body at the time of falling, each of the flat tablets is fed into the capsule body while being favorably kept under the flat state. Thus, the capsule body can be securely filled with the predetermined number of flat tablets under the flat state, without generating any flat tablet under a standing state.

EFFECTS OF THE INVENTION

As above-mentioned, according to the method for filling capsule body with tablet and the device for filling capsule with tablet based on the present invention, a capsule body can be securely filled with a predetermined number of flat tablets under a flat state, so that a capsule drug filled with the tablets can be favorably produced, while preventing as securely as possible the inconvenience arising from the generation of a flat tablet under a standing state.

BEST MODE FOR CARRYING OUT THE INVENTION AND EXAMPLES

Now, the present invention will be descried specifically below, by showing embodiments.

Figure 1:
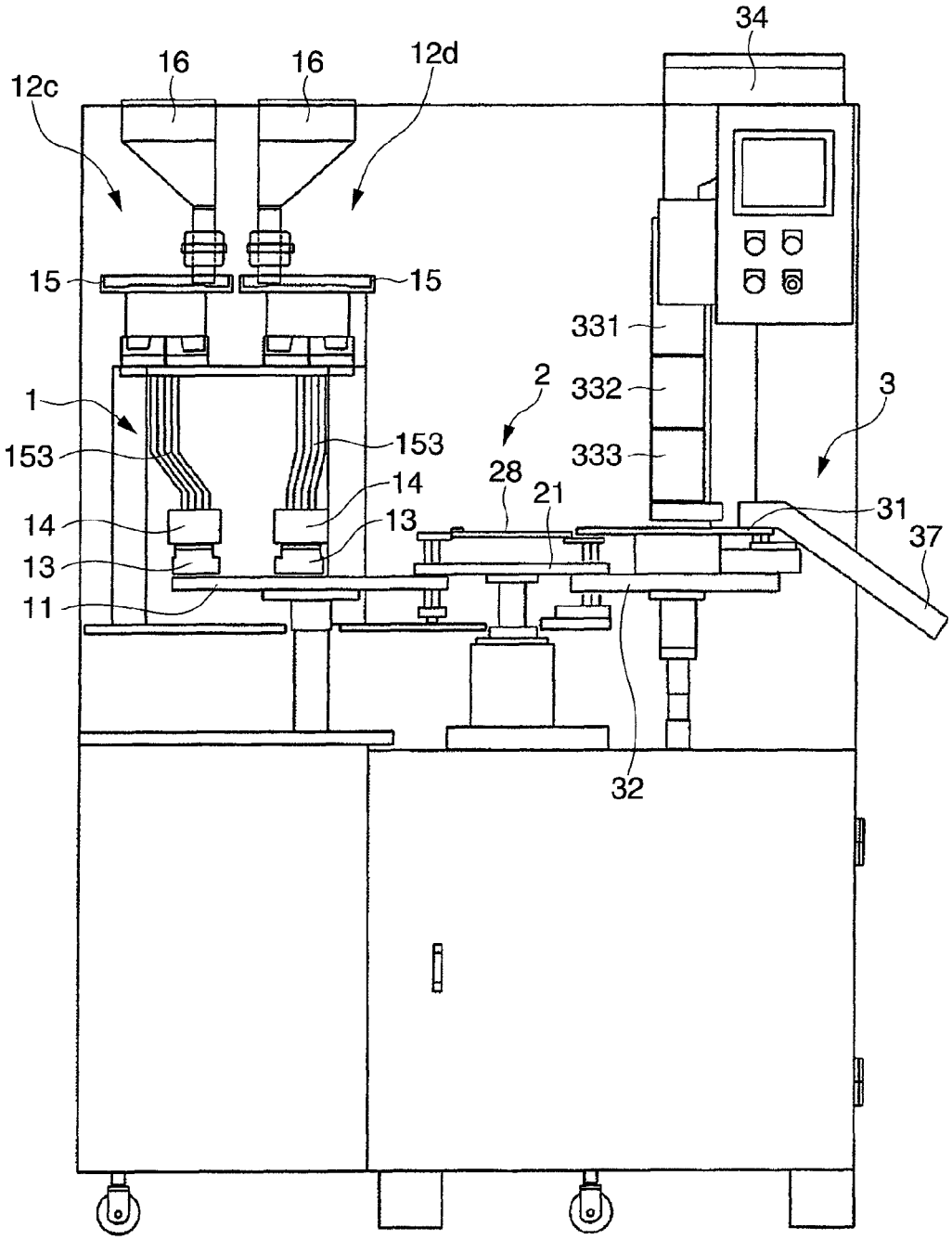
FIG. 1 is a schematic elevation showing a tablet filling device according to one embodiment of the present invention.
Figure 2:
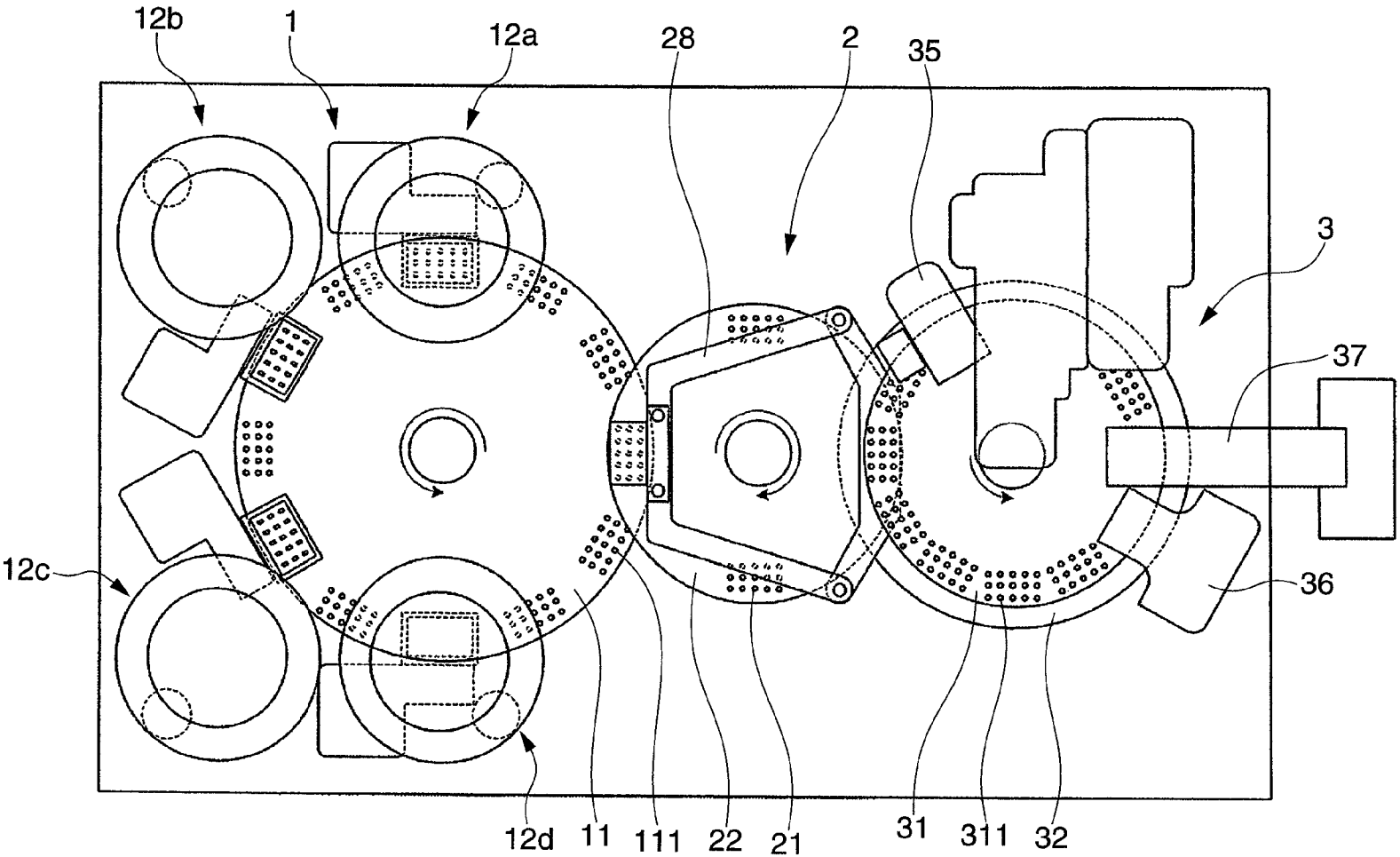
FIG. 2 is a schematic plan view showing the tablet filling device.

FIGS. 1 and 2 show a device for filling capsule with tablet configured to fill each of capsule bodies with flat tablets by use of the filling method according to the present invention. The device includes a tablet supplying mechanism unit 1, a tablet filling unit 2, and a capsule separating/coupling unit 3 (capsule body arranging mechanism unit). At the tablet supplying unit 1, a plurality of kinds (four kinds, in this embodiment) of flat tablets are collected on the basis of a predetermined number of tablets each (on the basis of one tablet each, in this embodiment) to form flat tablet groups, which are supplied to the tablet filling unit 2. At the capsule separating/coupling unit 3, empty capsules each formed by temporary coupling of a cap and a body are each separated into the cap and the body. Then, at the tablet filling unit 2, the capsule bodies are each filled with the flat tablet group consisting of a predetermined number of flat tablets. Thereafter, at the capsule separating/coupling unit 3, the capsule bodies and the caps are again coupled to each other, to produce capsulated drugs each filled with the predetermined number of flat tablets.

The tablet supplying unit 1 includes a counting disk 11 which is rotated intermittently, and four fixed-number-of-tablets supplying units 12*a* to 12*d*, as shown in FIGS. 1 and 2. As shown in FIG. 2, a circumferential edge section of the counting disk 11 is provided, at twelve locations displaced by a regular interval of 30 degrees, with counting hole groups each consisting of three 5-membered rows, and the counting disk 11 is intermittently rotated counterclockwise in FIG. 2 at a predetermined speed and by 30 degrees at a time.

Figure 3:
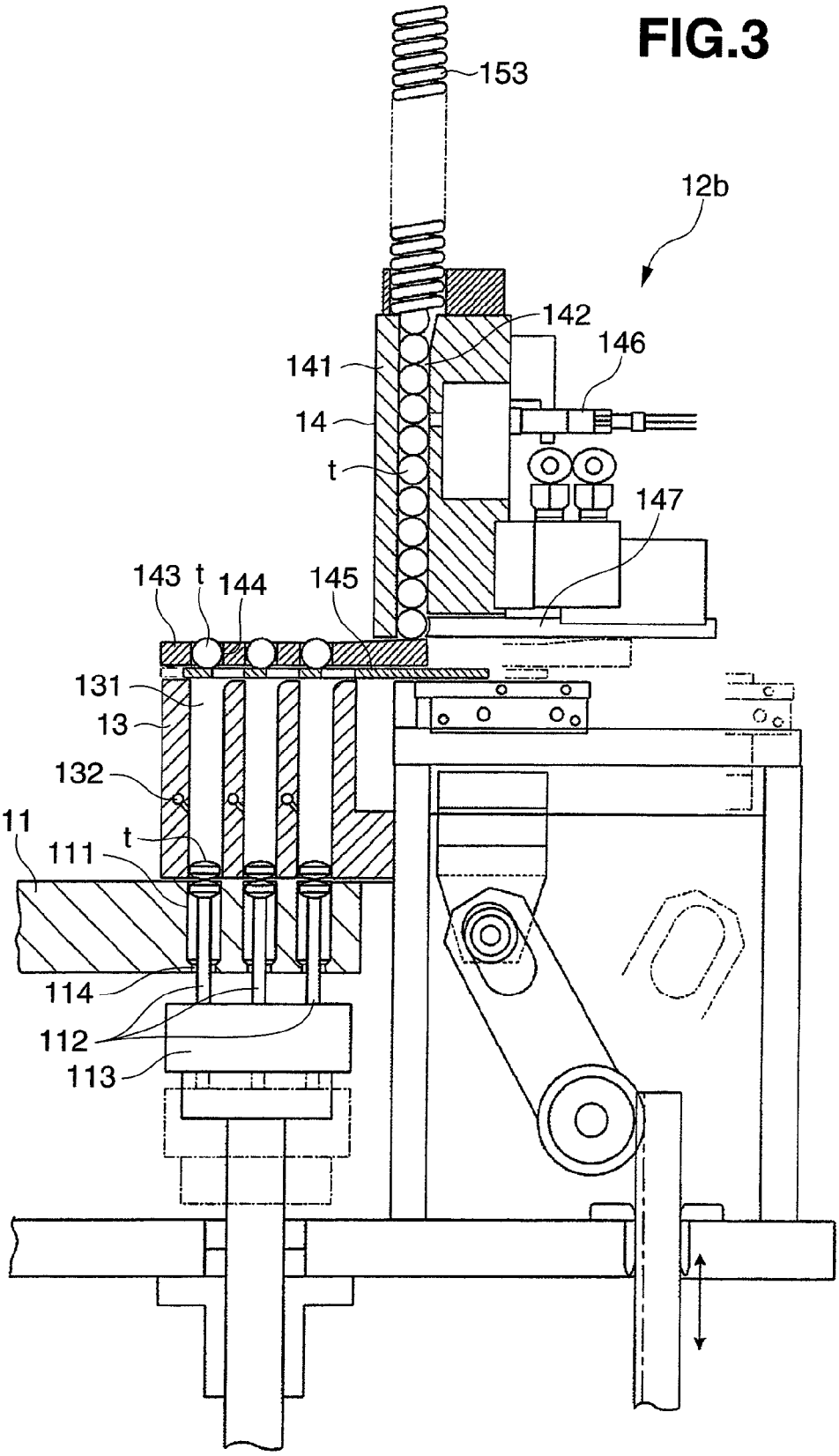
FIG. 3 is a partly sectional schematic view showing a lower part of a fixed-number-of-tablets supplying unit constituting the tablet filling device.
Figure 4:
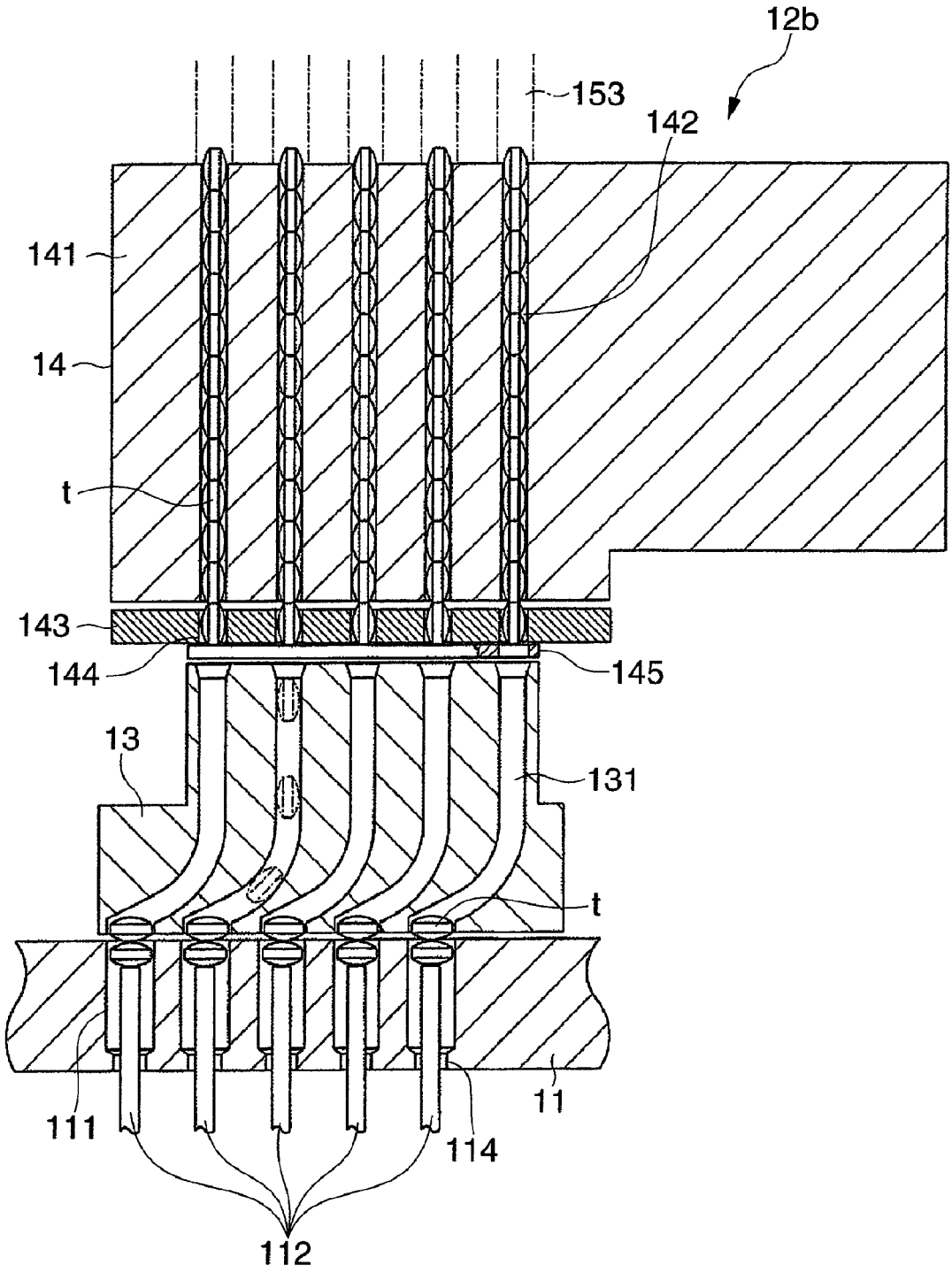
FIG. 4 is a partly sectional schematic view showing an intermediate part of the fixed-number-of-tablets supplying unit constituting the tablet filling device.

On the lower side of the counting disk 11, tablet holding pins 112 shown in FIGS. 3 and 4 are arranged in a total number of fifteen, specifically, in three 5-membered rows corresponding to the counting holes 111, at positions corresponding to the positions where the four fixed-number-of-tablets supplying units 12*a* to 12*d* are arranged. The tablet holding pins 112 are erectly provided on a base 113 (see FIG. 3) lifted up and down by a drive source (not shown). When moved upward, the tablet holding pins 112 pass through through-holes 114 formed in the bottom walls of the counting holes 111 to enter the counting holes 111. When moved downward to a lowermost point (into the state indicated by dot-dash lines in FIG. 3), the tablet holding pins 112 are completely withdrawn from the counting holes 111 and the through-holes 114. Incidentally, while FIGS. 3 and 4 show one fixed-number-of-tablets supplying unit 12*b*, the other fixed-number-of-tablets supplying units 12*a*, 12*c*, and 12*d* are configured in the same manner, except the lift-up (rising) height of the tablet holding pins 112 which will be described later.

Here, as shown in FIGS. 3 and 4, the counting holes 111 are open at their upper ends, are provided at their lower ends with bottom walls having through-holes 114, and have an inner diameter slightly larger than the diameter of the flat tablets (t) with which to fill the capsules so that the flat tablets (t) can be contained therein under a flat state.

Figure 12:
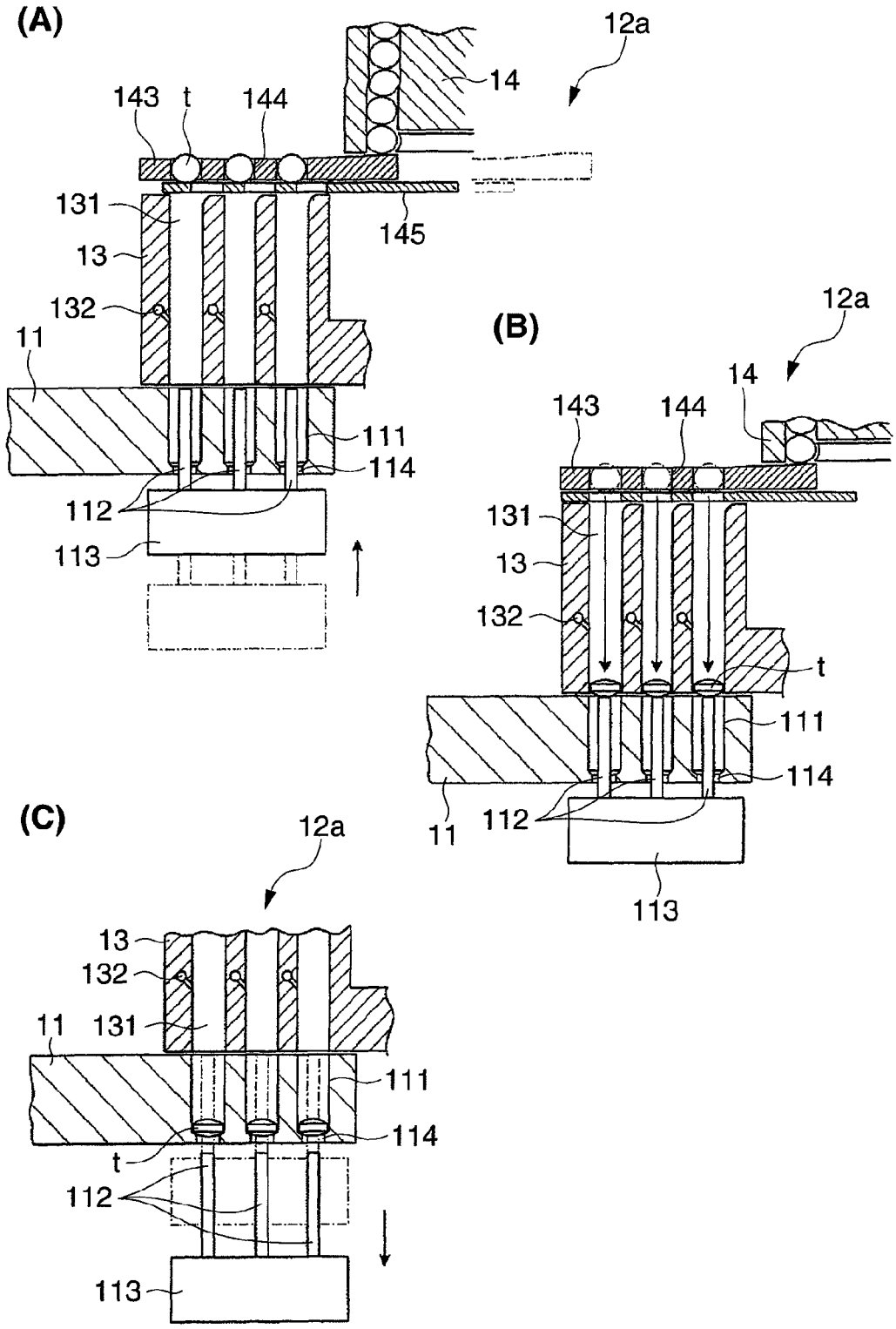
FIG. 12 illustrates a tablet supplying operation at a location where a fixed-number-of-tablets supplying unit 12*a* constituting the tablet filling device is arranged.
Figure 13:
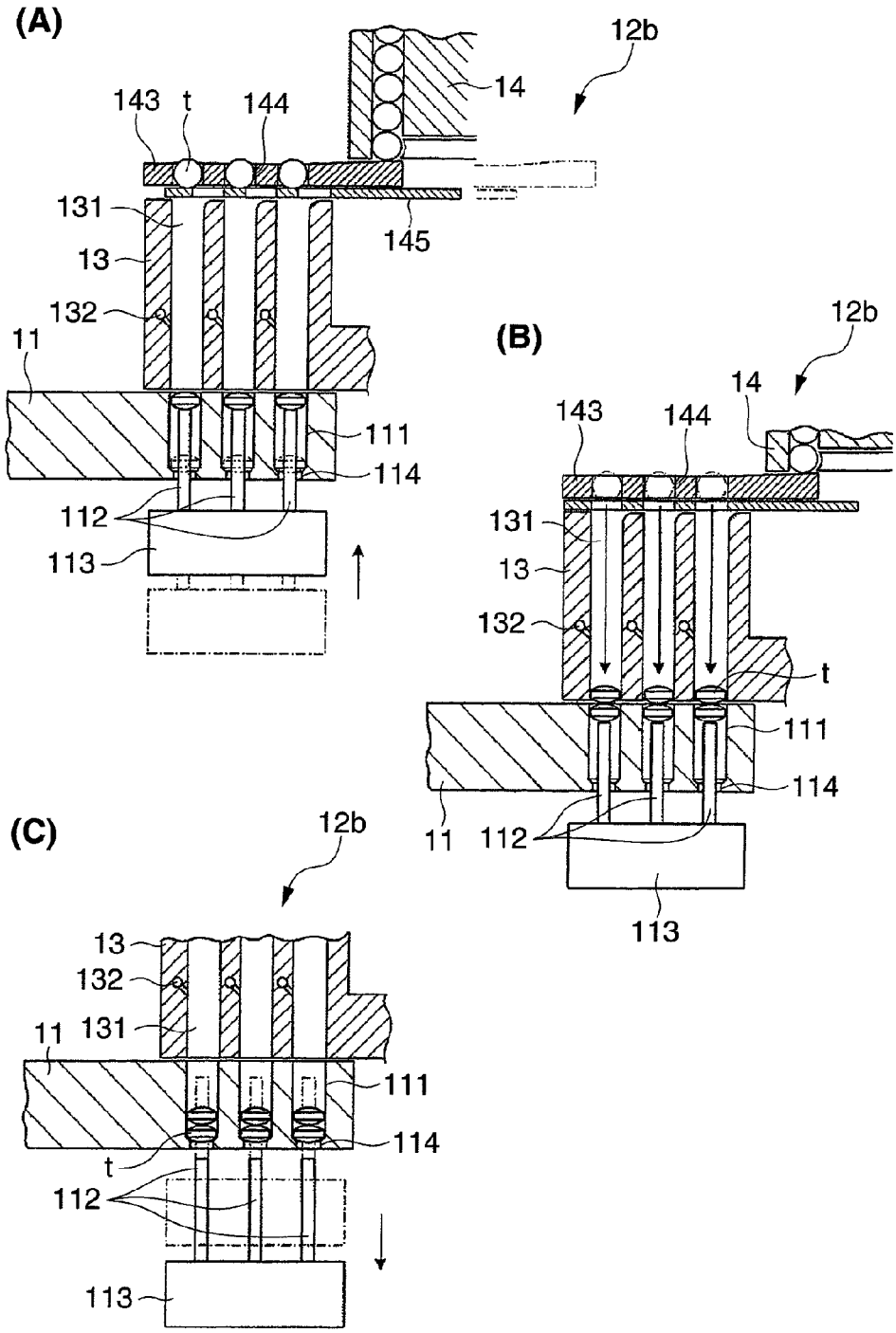
FIG. 13 illustrates a tablet supplying operation at a location where a fixed-number-of-tablets supplying unit 12*b* constituting the tablet filling device is arranged.
Figure 14:
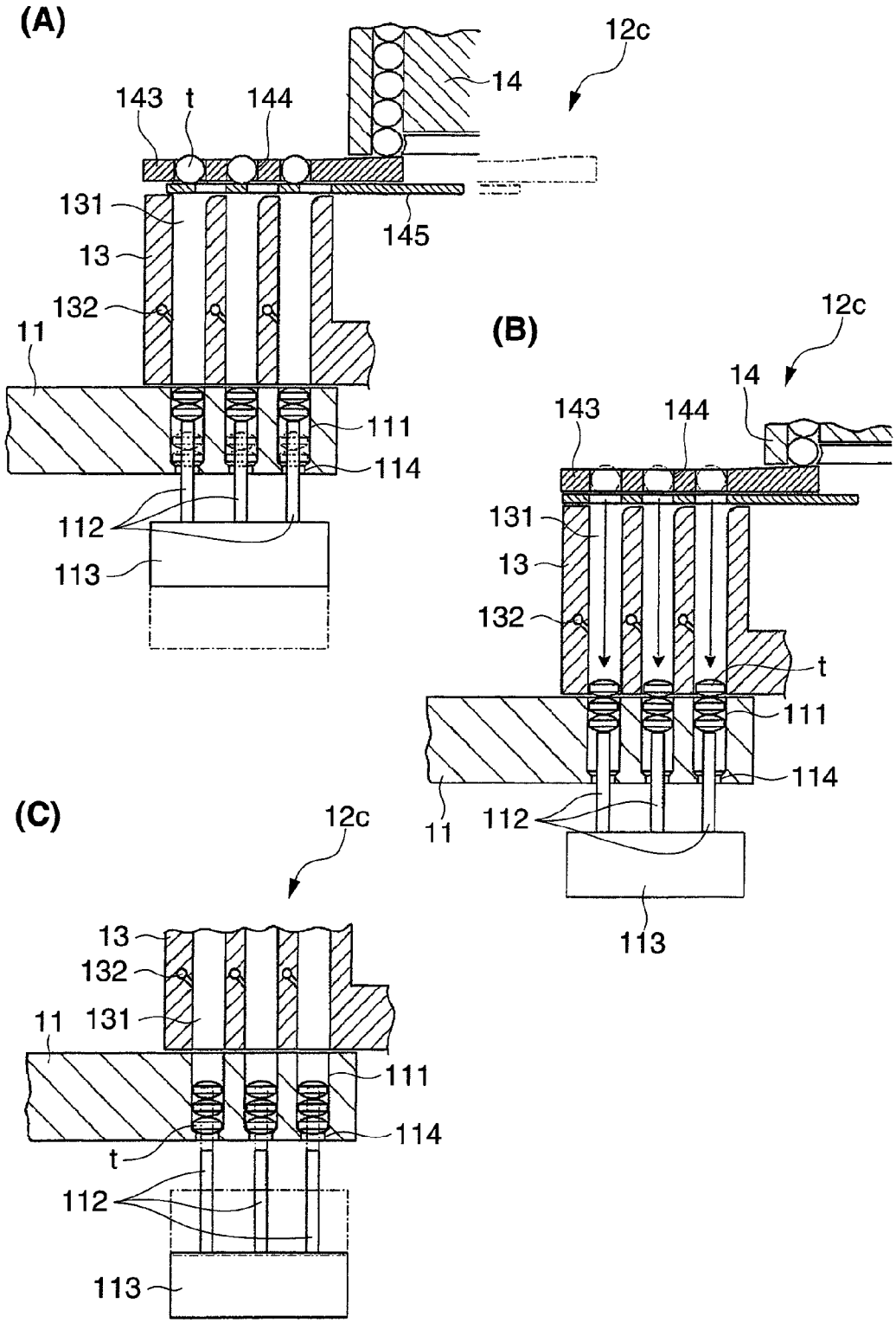
FIG. 14 illustrates a tablet supplying operation at a location where a fixed-number-of-tablets supplying unit 12*c* constituting the tablet filling device is arranged.
Figure 15:
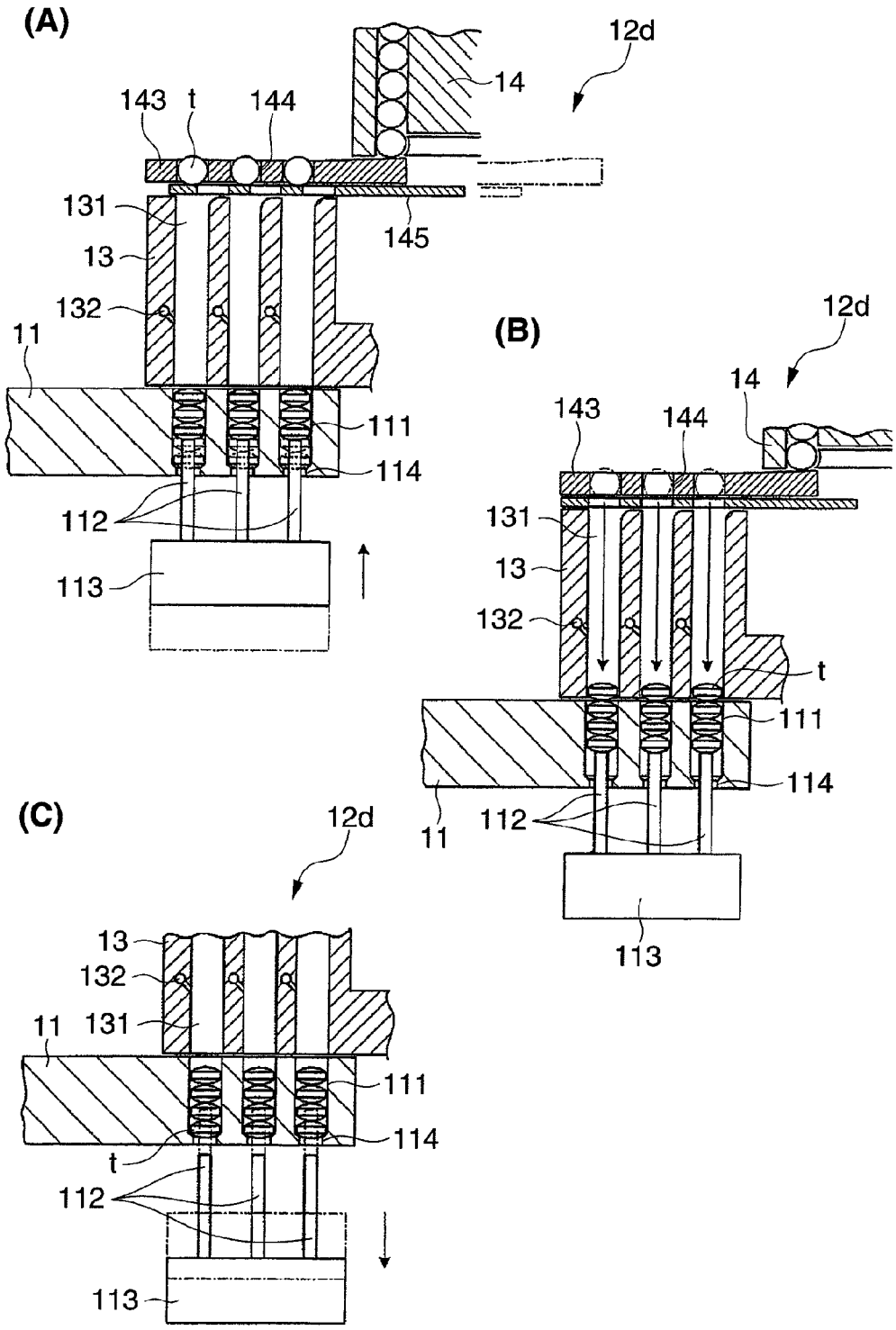
FIG. 15 illustrates a tablet supplying operation at a location where a fixed-number-of-tablets supplying unit 12*d* constituting the tablet filling device is arranged.

In addition, while the tablet holding pins 112 are arranged at four locations corresponding respectively to the four fixed-number-of-tablets supplying units 12*a* to 12*d* as above-mentioned, they are different in the uppermost point at the time of rising, according respectively to the arrangement locations thereof. Specifically, as shown in FIGS. 12(A) and 12(B), at the arrangement location of the fixed-number-of-tablets supplying unit 12a on the most upstream side along the rotating direction of the counting disk 11 (see FIG. 2), each of the tablet holding pins 112 rises to a position where its tip becomes substantially flush with the upper surface of the counting disk 11 so that the flat tablet (t) supplied from the fixed-number-of-tablets supplying unit 12 is received thereby at the upper end portion of the counting hole 111. In addition, as shown in FIGS. 13(A) and 13(B), at the arrangement location of the fixed-number-of-tablets supplying unit 12*b* at the second upstream position along the rotating direction of the counting disk 11 (see FIG. 2), each of the tablet holding pins 112 rises to such a position that one tablet (t) contained in the counting hole 111 is pushed up thereby to be substantially flush with the upper surface of the counting disk 11 and that the flat tablet (t) supplied from the fixed-number-of-tablets supplying unit 12 is received by the one tablet (t) at the upper end portion of the counting hole 111. Besides, as shown in FIGS. 14(A) and 14(B), at the arrangement location of the fixed-number-of-tablets supplying unit 12*c* at the third upstream position along the rotating direction of the counting disk 11 (see FIG. 2), each of the tablet holding pins 112 rises to such a position that two tablets (t) contained in the counting hole 111 are pushed up thereby until the upper one of the two tablets (t) becomes substantially flush with the upper surface of the counting disk 11 and that the flat tablet (t) supplied from the fixed-number-of-tablets supplying unit 12 is received by this upper tablet (t) at the upper end portion of the counting hole 111. Further, as shown in FIGS. 15(A) and 15(B), at the arrangement location of the fixed-number-of-tablets supplying unit 12*d* at the fourth upstream position along the rotating direction of the counting disk 11 (see FIG. 2), each of the tablet holding pins 112 rises to such a position that three tablet (t) contained in the counting hole 111 are pushed up thereby until the uppermost one of the tablets (t) becomes substantially flush with the upper surface of the counting disk 11 and that the flat tablet (t) supplied from the fixed-number-of-tablets supplying unit 12 is received by this uppermost tablet (t) at the upper end portion of the counting hole 111.

As shown in FIGS. 1 and 2, a part of the circumferential edge part (the part between the fixed-number-of-tablets supplying units 12*a* and 12*d*) of the counting disk 11 is located on the lower side of and overlapping with the filling disk 21 constituting the tablet filling unit 2, and, at this part, the flat tablets (t) in the counting holes 111 are supplied to the filling disk 21 of the tablet filling unit 2.

Figure 8:
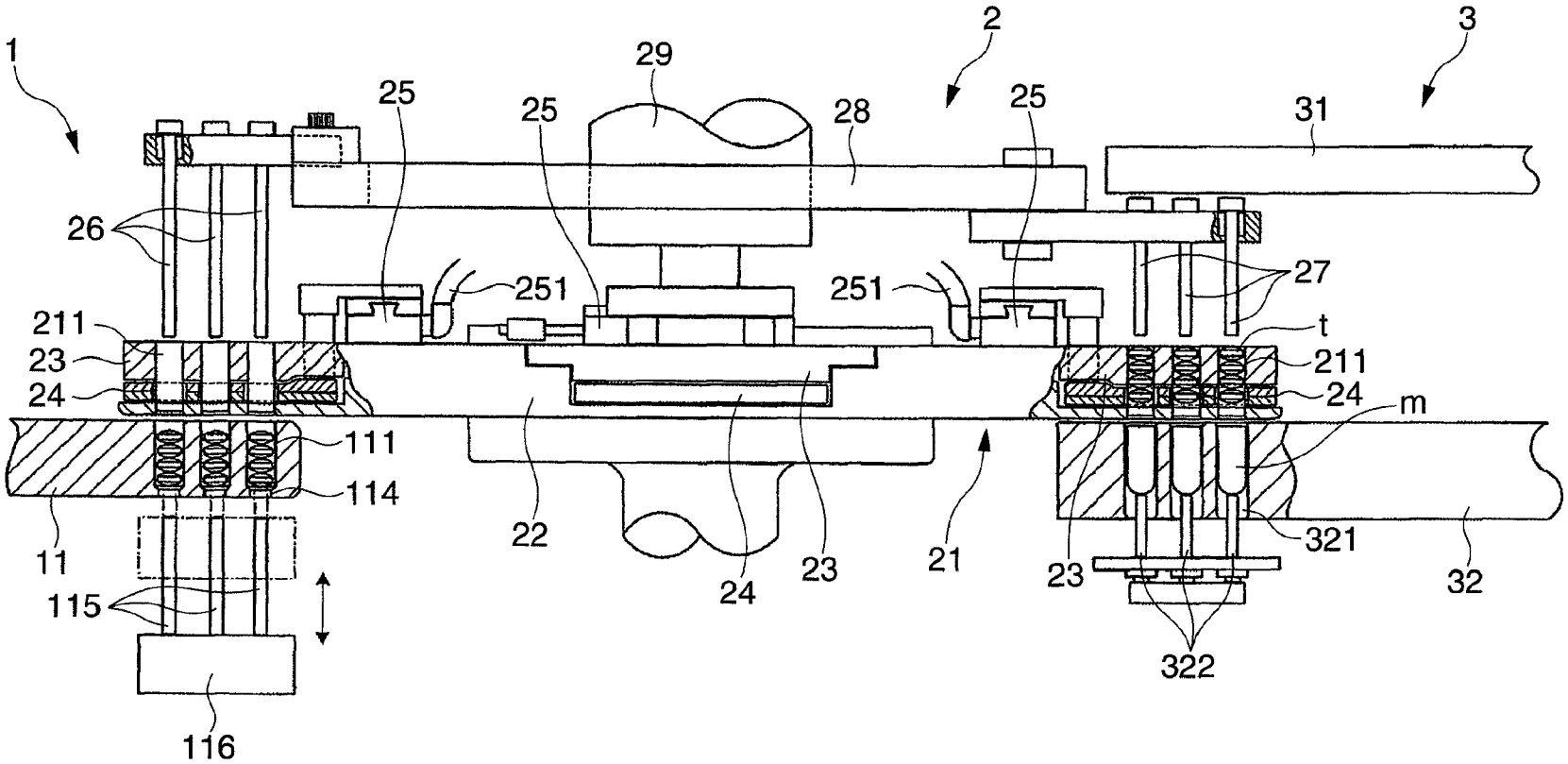
FIG. 8 is a partly sectional schematic view showing a filling unit constituting the tablet filling device.
Figure 9:
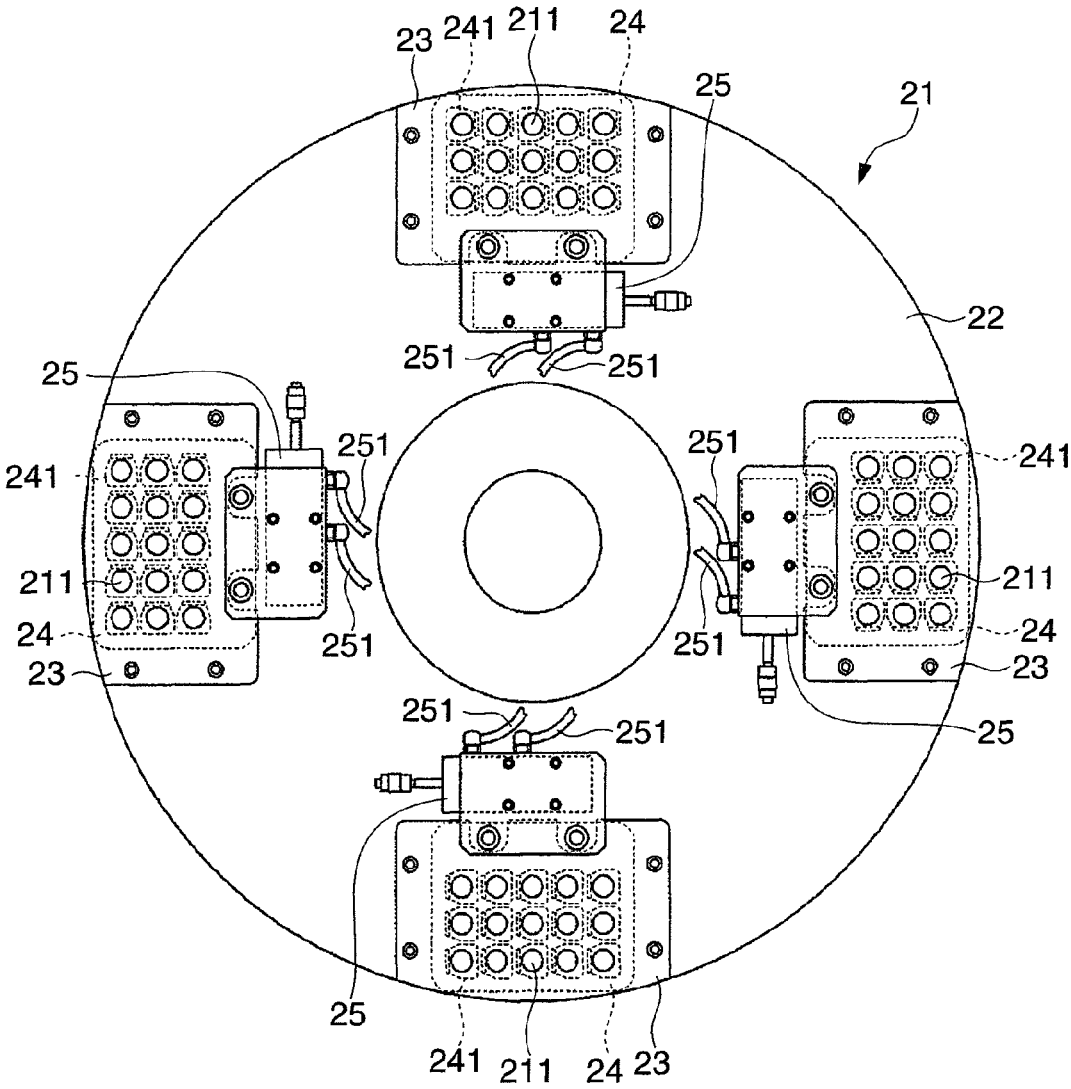
FIG. 9 is a schematic plan view showing a filling disk of the filling unit constituting the tablet filling device.
Figure 10:
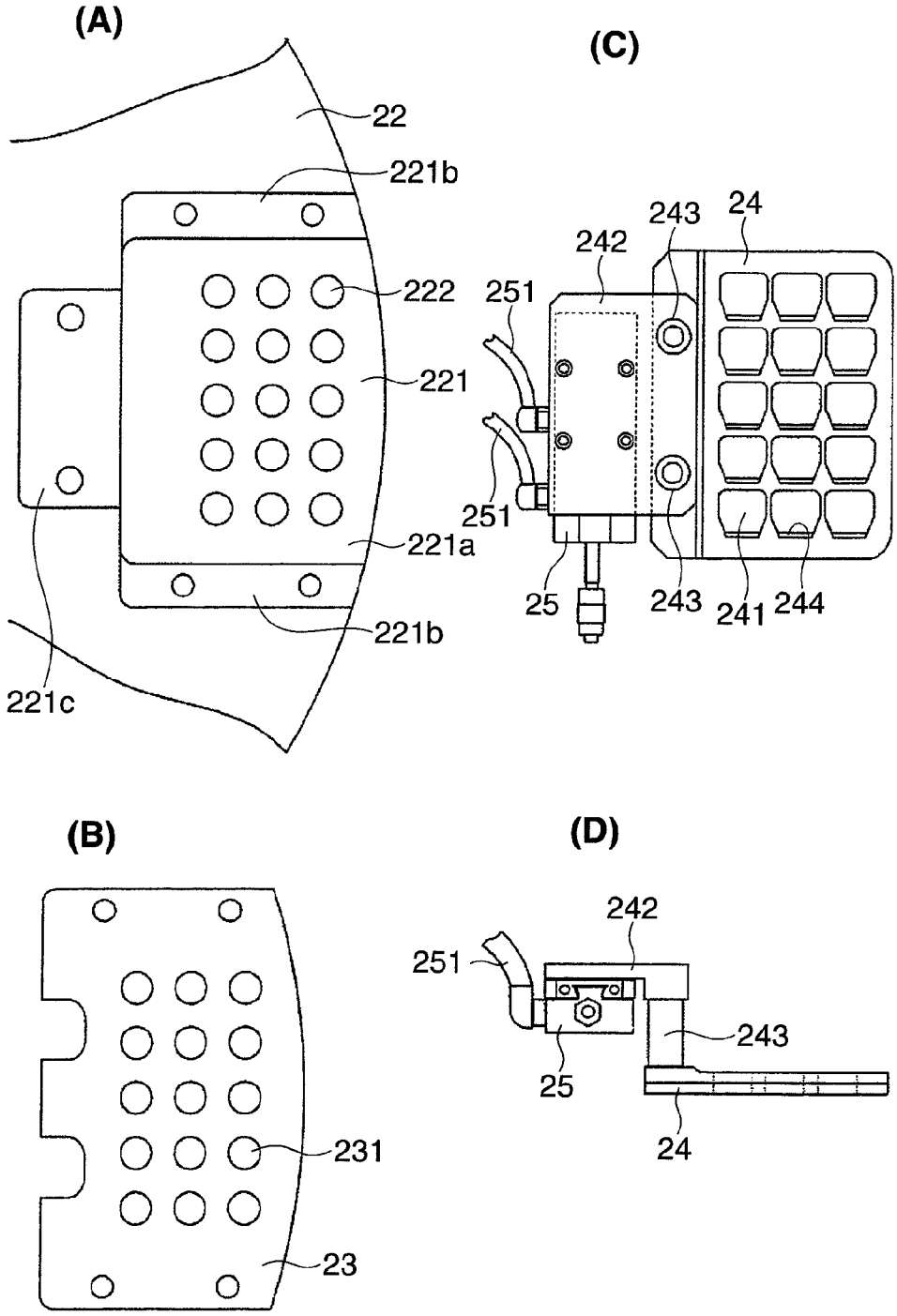
FIG. 10 illustrates component parts constituting the filling disk, wherein (A) is a schematic plan view showing a part of a disk body, (B) is a plan view showing a containing hole forming member, (C) is a plan view showing a tablet holding member, and (D) is a side view showing the tablet holding member.

At the overlapping part of the counting disk 11 and the filling disk 21, as shown in FIG. 8, a total of fifteen tablet discharge pins 115 are arranged on the lower side of the counting disk 11 in a pattern of three 5-membered rows corresponding to the counting holes 111. The tablet discharge pins 115 are erectly provided on a base 116 lifted up and down by a drive source (not shown). When moved upward, the tablet discharge pins 115 pass through through-holes 114 formed in the bottom walls of the counting holes 111, to enter the counting holes 111. Besides, when moved downward to a lowermost point, the tablet discharge pins 115 are completely withdrawn from the counting holes 111 and the through-holes.

Next, the fixed-number-of-tablets supplying units 12*a* to 12*d* constituting the tablet supplying mechanism unit 1 are the same or equivalent in configuration, and, as shown in FIG. 1, each of them includes a state converting block 13, a fixed-number-of-tablets supplier 14, a bowl feeder 15, and a hopper 16.

As shown in FIGS. 3 and 4, the state converting block 13 is provided therein with a total of fifteen state converting passages 131 in a pattern of three 5-membered rows corresponding to the arrangement of the counting holes 111 formed in the counting disk 11. Each of the state converting passages 131 is a through-hole passage having a roughly rectangular sectional shape of which two major sides are slightly longer than the diameter of the flat tablets (t) with which to fill the capsule, and two minor sides are slightly longer than the thickness of the flat tablets (t). Besides, as shown in FIG. 4, each state converting passage 131 is substantially vertical in the range from an upper part to an intermediate part thereof, a lower part thereof is a curved part curved by about 90 degrees, and the lower end opening thereof is formed as an opening slightly larger than the flat tablet (t).

As shown in FIGS. 3 and 4, the state converting block 13 is arranged with its lower end surface located close to the upper surface of the counting disk 11, and the flat tablets (t) in a vertical state with the radial direction thereof set vertical are fed from the fixed-number-of-tablets supplier 14 into each of the state converting passages 131. Then, as shown in FIG. 4, each flat tablet (t) thus fed into the state converting passage 131 is subjected to state conversion in the curved part of the state converting passage 131, and the flat tablet (t) under a flat state is supplied to the upper end of the counting hole 111 in the counting disk 11. Incidentally, reference symbol 132 in FIG. 3 and FIGS. 12 to 15 denotes compressed air jet nozzles which are provided at upper parts of the curved parts of the state converting passages 131. From each of the compressed air jet nozzles 132, compressed air is jetted downward into the curved part of the state converting passage 131, so as to form a downward airflow in the curved part where the flat tablet (t) is liable to stay instead of moving downward. Owing to this downward airflow, the state conversion of the flat tablet (t) takes place smoothly, and the flat tablet (t) is permitted to pass smoothly through the curved part of the state converting passage 131.

In the next place, the fixed-number-of-tablets supplier 14 has a chute block 141 provided therein with five tablet aligning passages 142. Like the above-mentioned state converting passages, each of the tablet aligning passages 142 formed in the chute block 141 is a through-hole passage having a roughly rectangular sectional shape of which two major sides are slightly longer than the diameter of the flat tablets (t) and two minor sides are slightly longer than the thickness of the flat tablets (t). As shown in FIGS. 3 and 4, the flat tablets (t) successively fed into each of the tablet aligning passages 142 through the upper end opening of the tablet aligning passage 142 are contained in the tablet aligning passage 142 in the state of being aligned in a row along the vertical direction and under a vertical state with the radial direction thereof set vertical, and are discharged through the lower end opening of the tablet aligning passage 142.

On the lower side of the chute block 14, a transfer plate 143 is arranged close to the lower end surface of the chute block 14 so as to be capable of sliding motions. The transfer plate 143 is provided therein with fifteen tablet holding holes 144 arrayed correspondingly to the state converting passages 131 in the state converting block 13. The flat tablets (t) under the vertical state are fed from the lower ends of the tablet aligning passages 142 into the tablet holding holes 144 to be contained and held in the latter, and, with the transfer plate 143 put into sliding motion, fifteen flat tablets (t) under the vertical state are moved to the upper ends of the state converting passages 131 in the state converting block 13.

On the lower side of the transfer plate 143, a shutter plate 145 for opening and closing the lower ends of the tablet holding holes 144 is arranged. As indicated by dot-dash lines in FIG. 3, the transfer plate 143 and the shutter plate 145 are integrally put into sliding motion by a drive source (not shown), whereby the flat tablets (t) are moved to the upper ends of the state converting passages 131. In addition, the shutter plate 145 is driven by an air cylinder (not shown) to slide, thereby opening/closing the lower ends of the tablet holding holes 144.

Incidentally, reference symbol 146 in FIG. 3 denotes a sensor for detecting the mixing of an unintended kind of tablet by color difference, and reference symbol 147 denotes a stopper for temporarily stopping the falling of the flat tablets (t).

Figure 5:
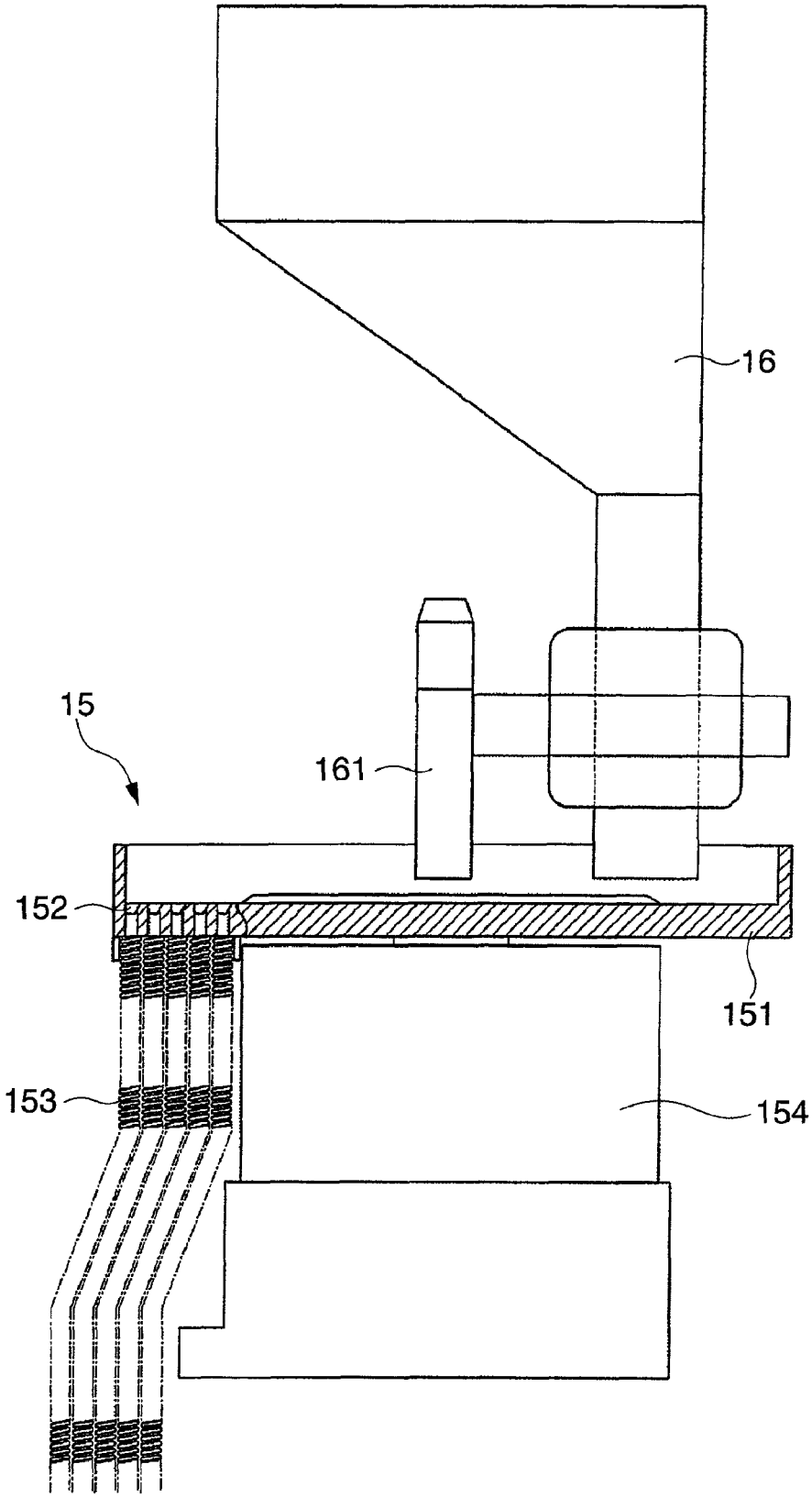
FIG. 5 is a partly sectional schematic view showing an upper part of the fixed-number-of-tablets supplying unit constituting the tablet filling device.
Figure 6:
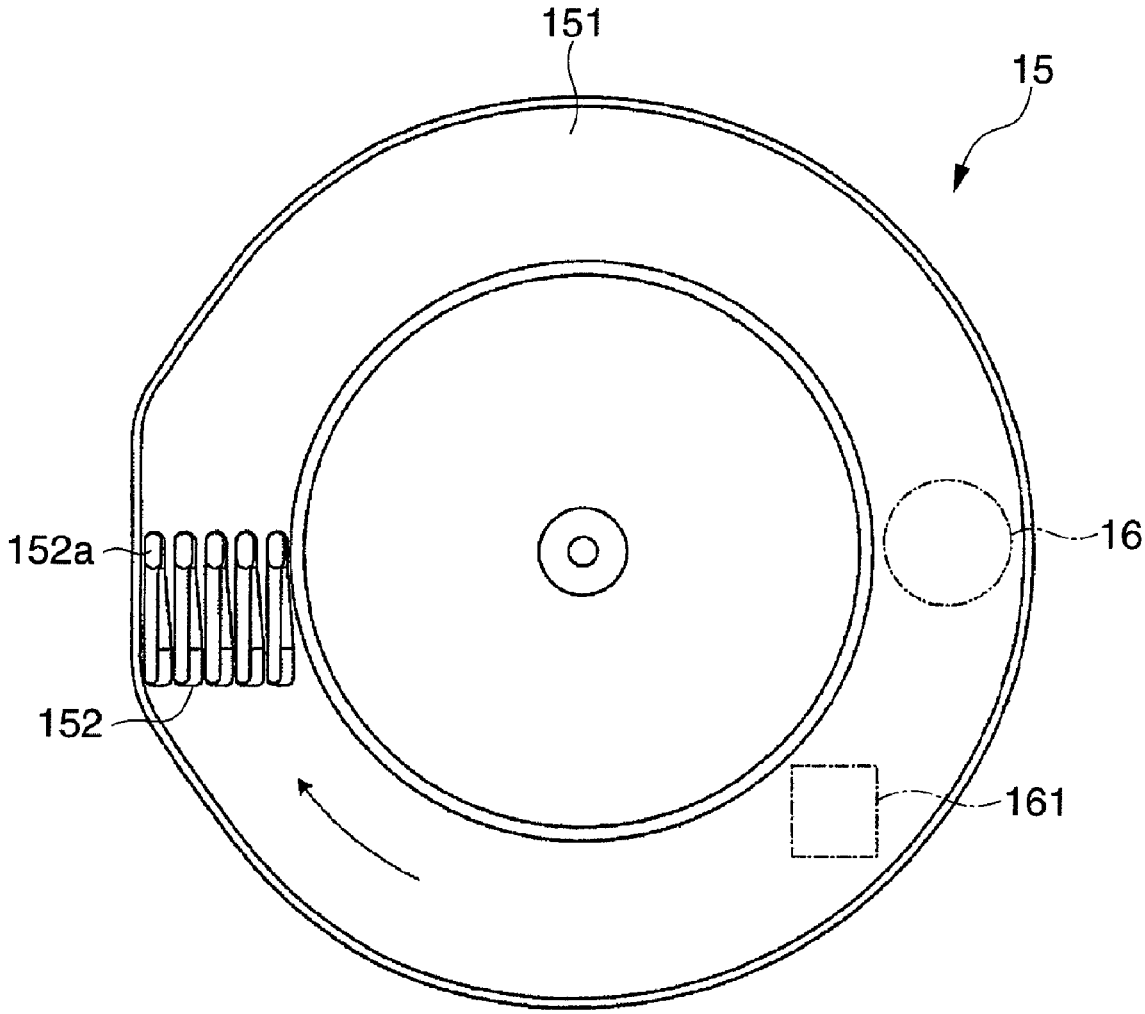
FIG. 6 is a schematic plan view showing a bowl feeder of the fixed-number-of-tablets supplying unit constituting the tablet filling device.

As shown in FIGS. 5 and 6, the bowl feeder 15 includes a roughly dish-like tablet containing section 151, and a vibrator 154 for giving micro-vibrations to the tablet containing section 151 so as to put the latter into an extremely minute reciprocal turning motion. With the micro-vibrations effected by the vibrator 154, the flat tablets supplied successively from the hopper 16 onto the tablet containing section 151 are moved clockwise in FIG. 6 (in the direction of arrow in the figure), the flat tablets are controlled in state into a vertical state by five state control grooves 152 formed on the tablet containing section 151, and are successively fed into the tablet aligning passages 142 in the chute block 14 through coil hoses 153 (see FIG. 5 and FIGS. 3 and 4).

Figure 7:
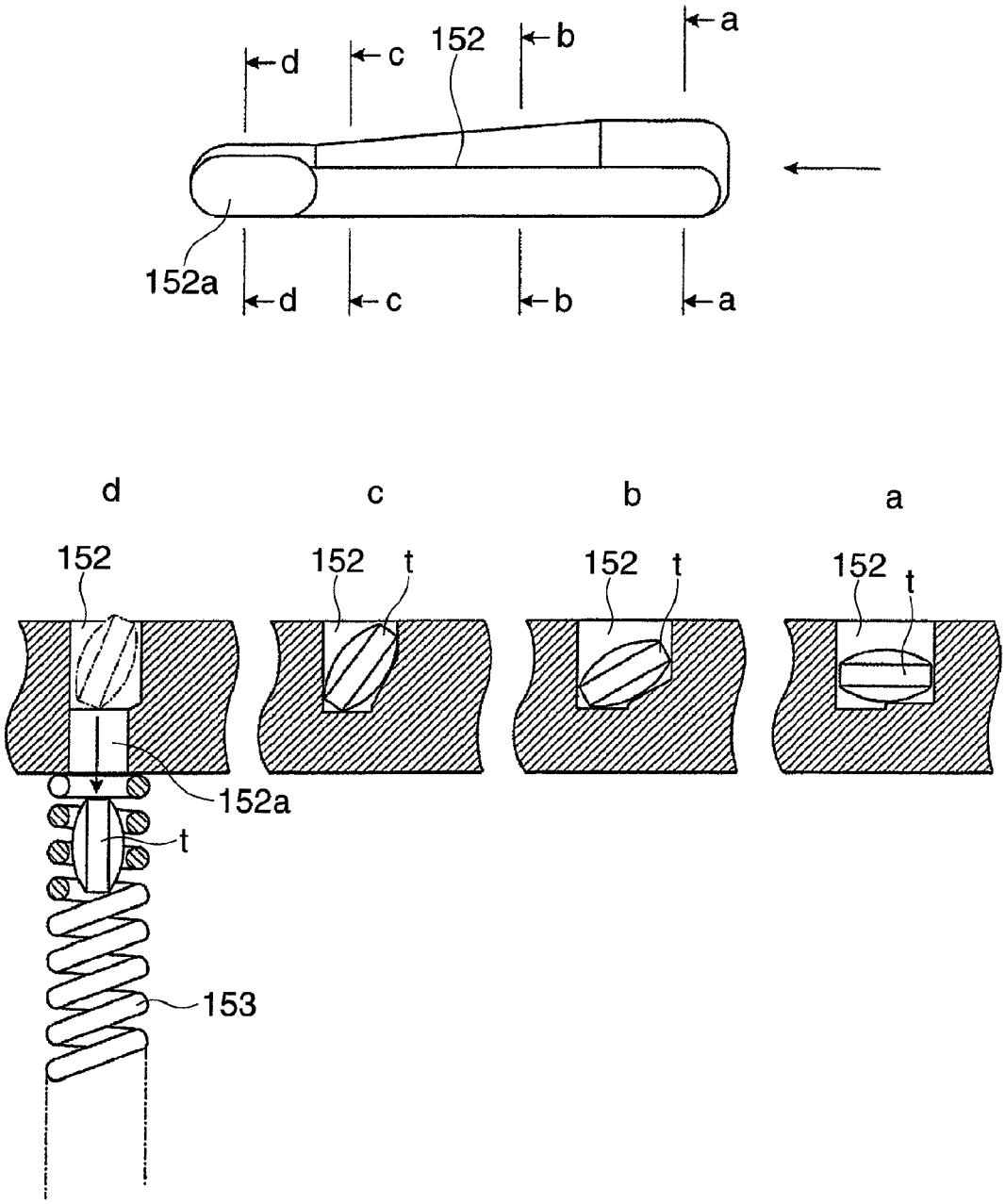
FIG. 7 shows illustrations for illustrating the shape and operation of each of state controlling grooves provided in the bowl feeder.

As shown in FIG. 7, each state control groove 152 is so formed that its bottom wall on one side is gradually inclined upward while its width is gradually reduced, along the moving direction of the flat tablet (t) (along the direction of arrow in the figure). Therefore, as sequentially shown in FIGS. 7*a* to 7*d*, the flat tablet (t) moving in the state control groove 152 is controlled in state gradually from a flat state to a vertical state, and is discharged downward under the vertical state from a discharge hole 152*a* formed in the bottom wall of a terminal end part of the state control groove 152. Besides, the discharge holes 152*a* of the state control grooves 152 are connected to the upper ends of the tablet aligning passages 142 in the chute block 141 through the coil hoses 153, so that the flat tablets (t) are successively supplied into the tablet aligning passages 142 in the chute block 141 under the vertical state.

Incidentally, reference symbol 161 in FIGS. 5 and 6 denotes a sensor for detecting excessive supply by detecting the upper surfaces of the flat tablets flowing on the tablet containing section 151 of the bowl feeder 15. When excessive supply is detected by this sensor 161, the supply of the tablets from the hopper 16 is temporarily stopped.

In the next place, as shown in FIGS. 1, 2 and 8, the tablet filling unit 2 has the filling disk 21 which is intermittently rotated at a predetermined speed. As shown in FIG. 2, a circumferential edge part of the filling disk 21 is provided with containing hole sections in four locations displaced at angular intervals of 90 degrees, each of the containing hole sections having a containing hole group including a total of fifteen containing holes 211 arrayed in three 5-membered rows similarly to the above-mentioned counting holes 111.

As shown in FIGS. 8-11, the filling disk 21 includes of a disk body 22 which is rotated intermittently, a containing hole forming member 23 firmly fitted in a circumferential edge part of the disk body 22, and a tablet holding member 24 arranged between the containing hole forming member 23 and the disk body 22. Besides, each of the containing holes 211 is defined by the disk body 22, the containing hole forming member 23 and the tablet holding member 24.

Figure 11:
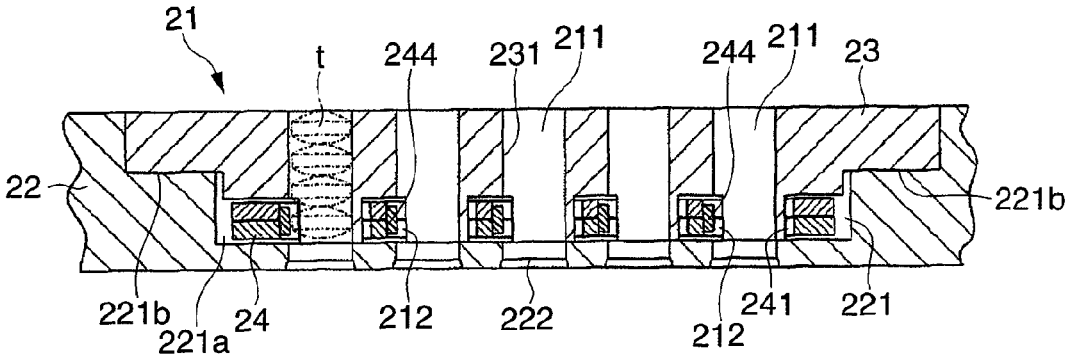
FIG. 11 shows sectional views of a containing hole forming section of the filling disk, wherein (A) is a transverse sectional view, and (B) is a longitudinal sectional view.
Figure 11:
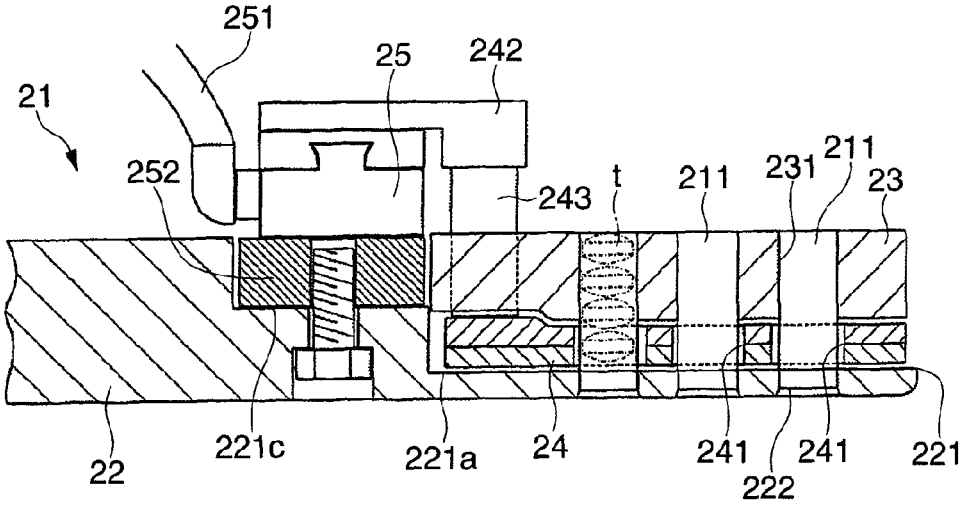

The disk body 22 is a circular plate-like member which is intermittently rotated by a drive source (not shown), and containing hole section forming recesses 221 shown in FIGS. 10(A) and 11 are formed on the upper side of a circumferential edge part of the disk body 22 at four locations displaced at angular intervals of 90 degrees. As shown in FIGS. 10(A) and 11, the containing hole section forming recess 221 is so formed that a roughly tetragonal recess body 221*a* is opened to the disk circumferential edge, shallow-bottomed forming member mounting sections 221*b* are formed at both side edge parts of the recess body 221*a*, with steps therebetween, and a shallow-bottomed air cylinder mounting section 221*c* is formed at a rear end edge part of the recess body 221*a*, with a step therebetween. In addition, the bottom wall of the recess body 221*a* is provided with through-holes 222 arrayed in three 5-membered rows. Further, the forming member mounting sections 221*b* and the air cylinder mounting section 221*c* are provided with screw holes for fixing the containing hole forming member 23 and the air cylinder.

In addition, as shown in FIGS. 10(B) and 11, the containing hole forming member 23 is a thick plate-like member provided with through-holes 231 arranged in three 5-membered rows, is fitted in the containing hole section forming recess 221, and is fixed by screwing both side edge parts thereof to the forming member mounting section 221*b*. On the lower surface of the containing hole forming member 23, small projections which are C-shaped in section are provided in the state of communicating with the above-mentioned through-holes 231, and the small projections are in contact with the bottom surface of the recess body 221*a* in the state of communicating with the through-holes 222 in the recess body 221*a*. As a result, the through-holes 231 in the containing hole forming member 23 and the through-holes 222 in the bottom wall of the recess body 221*a* communicate with each other through the small projections C-shaped in section, and, as shown in FIG. 11, the containing holes 211 are defined by both the through-holes 221 and 222. Besides, a space part is formed between the lower surface of the containing hole forming member 23 and the bottom surface of the recess body 221*a*, and notch parts of the sectionally C-shaped small projections on the lower surface of the containing hole forming member 23 serve as through-hole windows 212 through which the space part and the containing holes 211 communicate with each other.

Next, as shown in FIGS. 10(C) and 10(D), the tablet holding member 24 is a plate-like member provided with roughly deformed tetragonal pinching holes 241 arrayed in three 5-membered rows, and is supported through support posts 243, 243 to an arm plate 242 which is attached to an air cylinder 25. As shown in FIG. 11, the tablet holding member 24 is slidably disposed in the space part formed between the lower surface of the containing hole forming member 23 and the bottom surface of the recess body 221*a*, and the air cylinder 25 is mounted to the air cylinder mounting section 221*c* through a spacer 252, whereby the tablet holding member 24 is mounted to the containing hole section forming recess 221. Here, as shown in FIG. 11, the tablet holding member 24 is disposed in the space part so that each pinching hole 241 surrounds each containing hole 211.

Here, the tablet holding member 24 is formed by laminating two plate-like members, with a silicone rubber sandwiched between both the plate-like members. Besides, the silicone rubber partially projects into each pinching hole 241, and the projecting silicone rubber part serves as a pinching section 244 for pinching the flat tablet (see FIGS. 10(C) and 11(A)). Besides, as shown in FIG. 11(A), the pinching sections 244 are inserted into the through-hole windows 212 formed in the containing holes 211, so as to front on the inside of the containing holes 211 by way of the through-hole windows 212.

The tablet holding member 24 is driven by the air cylinder 25 to get into sliding motion, and, when it slides in one direction, the pinching section 244 of each pinching hole 241 enters each containing hole 211 by way of the through-hole window 212, to pinch the flat tablet (t) containing in the containing hole 211. On the other hand, when the tablet holding member 24 slides in the reverse direction, each pinching section 244 withdraws from each containing hole 211. Incidentally, reference symbol 251 in FIGS. 8, 9, 10(C) and 10(D) denotes an air pipe for supplying compressed air into the air cylinder 25, and, though not particularly shown, the other end of each air pipe 251 is connected to a commercially available "multi-circuit block for rotary part in piping" (not shown) provided on a support column 29 supporting the filling disk 21.

As above-mentioned, the filling disk 21 constituting the filling unit 2 of the filling device in the present embodiment is provided with the containing hole sections including the containing hole groups which each have the containing holes 211 arrayed in three 5-membered rows and which are located in four locations displaced at angular intervals of 90 degrees (see FIG. 9); in addition, the filling disk 21 is intermittently rotated at a predetermined speed and by 90 degrees at a time. In addition, as shown in FIG. 8, a part of a circumferential edge part of the filling disk 22 is overlappingly disposed on the upper side of a circumferential edge part of the counting disk 11, and, at a position displaced from this part by 180 degrees, a part of the circumferential edge part of the filling disk 22 is overlappingly disposed on the upper side of a body disk 32 of the capsule separating/coupling unit 3. Furthermore, when the rotating motion is intermittently stopped, at the part of overlapping with the counting disk 11, the containing holes 211 in the filling disk 21 and the counting holes 111 in the counting disk 11 are coinciding and communicating with each other, and, at the part of overlapping with the body disk 32, the containing holes 211 in the filling disk 21 and body holding holes 321 in the body disk 32 are coinciding and communicating with each other.

In addition, in the overlapping area of the counting disk 11 and the filling disk 21, fifteen supplying-time tablet presser pins 26 arrayed similarly to the containing holes 211 are vertically movably arranged on the upper side of the filling disk 21. Also, in the overlapping area of the body disk 32 and the filling disk 21, fifteen filling-time tablet presser pins 27 arrayed similarly to the containing holes 211 are vertically movably arranged on the upper side of the filling disk 21.

Both the supplying-time tablet presser pins 26 and the filling-time tablet presser pins 27 are vertically moved while being supported by an arm body 28, which is vertically moved by a drive source (not shown). When moved downward, the pins enter the containing holes 211 in the filling disk 21, and, when moved upward, the pins withdraw upward from the containing holes 211. Furthermore, both the supplying-time tablet presser pins 26 and the filling-time tablet presser pins 27 are vertically movably supported on the arm body 28, so that they can also be vertically moved relative to the arm body 28 within predetermined ranges.

Incidentally, though not particularly shown in the figures, the filling unit 2 is provided with a laser type high-precision displacement sensor for detecting from above the upper surfaces of the flat tablets (t) contained in the containing holes 211. The height of the flat tablets (t) contained in each containing hole 211 is measured by the displacement sensor, whereby it is confirmed whether or not a predetermined number (four, in this embodiment) of the flat tablets (t) are being contained in the containing hole 211.

Next, as shown in FIG. 1, the capsule separating/coupling unit 3 includes: a capsule supplying unit having two disks consisting of a cap disk 31 and a body disk 32 arranged in parallel at a predetermined interval, and three drums 331, 332, 333; and a hopper 34.

The capsule separating/coupling unit 3 once separates each empty capsule, which has been formed by tentatively coupling a cap with a body, into the cap and the body, then feeds the capsule body in this condition to the filling unit 2, and thereafter couples again the capsule body filled with tablets at the filling unit 2 with the cap, thereby producing a capsulated drug filled with the tablets.

Specifically, the empty capsules are successively supplied from the hopper 34. The empty capsules are fed downward through transfer between the three drums 331, 332, 333 while containing the empty capsules in pockets formed at outer circumferential surfaces of the drums 331, 332, 333. During when being fed through the drums 331, 332 and 333, all the empty capsules are controlled in state into an upright state with its cap up, and the empty capsules under this upright state are fed to the cap disk 31 below. Then, the empty capsules are separated into caps and bodies by predetermined means at a capsule separating mechanism unit 35 (see FIG. 2). The caps are fed by holding them in cap holding holes 311 (see FIG. 2) in the cap disk 31, whereas the capsule bodies are fed to the lower side of the filling disk 21 by holding them in body holding holes 321 in the body disk 32 (see FIG. 8). The capsule bodies each filled with a predetermined number of tablets (t) on the lower side of the filling disk 21 are fed further, and the capsule bodies and the caps are coupled with each other by predetermined means at a capsule coupling unit 36 (see FIG. 2), to produce capsulated drugs filled with the tablets. The capsulated drugs are discharged to the upper side of the cap disk 31, and are recovered through a discharge chute 37 (see FIGS. 1 and 2).

Here, as shown in FIG. 8, a part of the circumferential part of the body disk 32 is overlappingly disposed on the lower side of the filling disk 21 as above-mentioned, and, in this overlapping area, the body holding holes 321 in the body disk 32 and the containing holes 211 in the filling disks 21 are coinciding and communicating with each other. Besides, in this overlapping area, body holding pins 322 are vertically movably arranged on the lower side of the body disk 32. By a drive source (not shown), the body holding pins 322 are moved upward to enter the body holding holes 321, whereby the capsule bodies (m) contained in the body holding holes 321 are pushed up to the upper end edges of the body holding holes 321; besides, the body holding pins 322 are moved downward to withdraw from the body holding holes 321.

Now, operations at the time of filling capsules with flat tablets by use of the tablet filling device according to this embodiment will be described below.

The tablet filling device according to this embodiment is so used that each capsule is filled with a total of four flat tablets, one tablet for each of four kinds, to produce a capsulated drug filled with the four kinds of flat tablets. The different kinds of flat tablets (t) are placed respectively in the four fixed-number-of-tablets supplying units 12*a* to 12*b*. In this case, the flat tablets are all formed in the same shape and the same size, though they are different in the kind of drug.

With the device started under this condition, the fixed-number-of-tablets supplying units 12*a* to 12*d* perform respective tablet supplying operations, the counting disk 11 is intermittently rotated at a predetermined speed, and the flat tablets (t) are sequentially fed into the counting holes 111 in the counting disk 11 at the arrangement locations of the fixed-number-of-tablets supplying units 12*a* to 12*d*, whereby four flat tablets are contained in each of the counting holes 111 under a flat stacked state.

First, the flat tablets (t) placed at random in the hopper 16 (see FIGS. 1 and 5) are successively supplied onto the tablet containing section 151 of the bowl feeder 15. The flat tablets (t) are then moved on the tablet containing section 151 in the direction of arrow in FIG. 6 by the micro-vibrations, to sequentially enter the state control grooves 152 formed on the tablet containing section 151. As shown in FIG. 7, while moving forward in the state control grooves 152, the flat tablets (t) are controlled in state into a vertical state, and successively fall into the coil hoses 153 under the vertical state.

As shown in FIG. 3, the flat tablets (t) falling through the coil hoses 153 are fed into the tablet aligning passages 142 in the chute block 141 as they are under the vertical state, and, at the lower ends of the tablet aligning passages 142, they are contained into the tablet holding holes 144 in the transfer plate 143. Then, the transfer plate 143 is slid, whereby the flat tablets (t) under the vertical state are disposed just over the state converting passages 131 in the state converting block 13.

At the fixed-number-of-tablets supplying unit 12*a* on the most upstream side, as shown in FIG. 12(A), first, the tablet holding pins 112 arranged on the lower side of the counting disk 11 are moved upward to enter the counting holes 111, and are stopped at positions where their tips are substantially flush with the upper surface of the counting disk 11. In this condition, as shown in FIG. 12(B), the shutter plate 145 beneath the transfer plate 143 is slid by a drive source (not shown) to open the lower ends of the tablet holding holes 144, so that the flat tablets (t) are fed into the state converting passages 131 in the state converting block 13 under the vertical state. The flat tablets (t) fall through the state converting passages 131, are controlled in state into a flat state while passing through the curved parts (see FIG. 4), are fed to positions just over the counting holes 111, and are received by the tablet holding pins 112. Then, as shown in FIG. 12(C), the tablet holding pins 112 are moved downward, whereby the tablets (t) are held in the bottom parts of the counting holes 111 under the flat state, and the tablet holding pins 112 are withdrawn from the counting holes 111. In this condition, the counting disk 11 is intermittently rotated, whereby the counting holes 111 each having the tablet (t) contained therein are fed to the arrangement location of the next fixed-number-of-tablets supplying unit 12*b*.

Here, detailed operations at the time of feeding the flat tablets (t) from the tablet aligning passages 142 in the chute block 141 into the state converting passages 131 in the state converting block 13 through the transfer plate 143 are as follows.

First, the transfer plate 143 with the tablet holding holes 144 empty upon feeding the flat tablets (t) therefrom into the state converting passages 131 is slid rearward, with the tablet holding holes 144 shut with the shutter plate 145, to be moved to the position indicated by dot-dash lines in FIG. 3. In this instance, the transfer plate 143 is slid rearward in the condition where the flat tablet contained at the lowermost position in each tablet aligning passage 142 is locked by pressing it with the stopper 147. In addition, the transfer plate 143 is formed in a tapered shape such that it is thicker on the side of its rear end part. Therefore, the upper surface of the transfer plate 143 thus slid rearward and the tablets at the lowermost positions in the tablet aligning passages 142 are separate from each other, so that the transfer plate 143 can be withdrawn without such inconvenience as grinding of the flat tablets. After the withdrawal of the transfer plate 143, the locking of the tablets at the lowermost positions by the stopper 147 is released, the transfer plate 143 is slid forwards, the flat tablets (t) are contained into the tablet holding holes 144 from the tablet aligning passages 142, and are conveyed forwards, to be located just over the state converting passages 131. Then, as above-mentioned, the shutter plate 145 is slid to open the lower ends of the tablet holding holes 144, whereby the flat tablets (t) are let fall into the state converting passages 131.

Next, at the second fixed-number-of-tablets supplying unit 12*b*, as shown in FIG. 13(A), first, the tablet holding pins 112 are each moved upward to enter each counting hole 111, each push up the one preceding flat tablet (t) contained in each counting hole 111 to such a position as to be substantially flush with the upper surface of the counting disk 11, and are stopped there. Under this condition, as shown in FIG. 13(B), like in the fixed-number-of-tablets supplying unit 12*a*, the shutter plate 145 is slid to open the lower ends of the tablet holding holes 144, the flat tablets (t) are controlled in state into a flat state while passing through the state converting passages 131, the flat tablets (t) are fed to positions just over the counting holes 111, and each of the flat tablets (t) is received on the one preceding flat tablet at the upper end of the counting hole 111. Subsequently, as shown in FIG. 13(C), like in the fixed-number-of-tablets supplying unit 12*a*, the tablet holding pins 112 are moved downward to be withdrawn from the counting holes 111, and the counting disk 11 with the two flat tablets (t) held in the bottom part of each of the counting holes 111 is intermittently rotated, whereby the counting holes 111 each having the two flat tablets (t) contained therein are conveyed to the arrangement location of the next fixed-number-of-tablets supplying unit 12*c*.

At the third fixed-number-of-tablets supplying unit 12*c*, as shown in FIG. 14(A), first, the tablet holding pins 112 are each moved upward to enter each counting hole 111, each push up the two preceding flat tablets (t) contained in each counting hole 111, and are each stopped at a position where the uppermost one of the two preceding flat tablets (t) becomes substantially flush with the upper surface of the counting disk 11. In this condition, as shown in FIG. 14(B), like in the fixed-number-of-tablets supplying units 12*a* and 12*b*, the shutter plate 145 is slid to open the lower ends of the tablet holding holes 144, whereby the flat tablets (t) are controlled in state into a flat state while passing through the state converting passages 131, the flat tablets (t) are fed to positions just over the counting holes 111, and each of these flat tablets (t) is received on the uppermost one of the preceding flat tablets (t) at the upper end of each counting hole 111. Subsequently, as shown in FIG. 14(C), like in the fixed-number-of-tablets supplying units 12*a* and 12*b*, the tablet holding pins 112 are lowered to withdraw from the counting holes 111, and the counting disk 11 with the three flat tablets (t) held in the bottom part of each counting hole 111 is intermittently rotated, whereby the counting holes 111 each having the three flat tablets (t) contained therein are conveyed to the arrangement location of the next fixed-number-of-tablets supplying unit 12*d*.

Next, at the fourth fixed-number-of-tablets supplying unit 12*c*, as shown in FIG. 15(A), the tablet holding pins 112 are each moved upward to enter each counting hole 111, each push up the three preceding flat tablets (t) contained in each counting hole 111, and are each stopped at a position where the uppermost one of the three preceding flat tablets (t) becomes substantially flush with the upper surface of the counting disk 11. In this condition, as shown in FIG. 15(B), like in the fixed-number-of-tablets supplying units 12*a* to 12*c*, the shutter plate 145 is slid to open the lower ends of the tablet holding holes 144, the flat tablets (t) are controlled in state into a flat state while passing through the state converting passages 131, the flat tablets (t) are fed to positions just over the counting holes 111, and each of these flat tablets (t) is received on the uppermost one of the three preceding flat tablets (t) at the upper end of each counting hole 111. Subsequently, as shown in FIG. 15(C), like in the fixed-number-of-tablets supplying units 12*a* to 12*c*, the tablet holding pins 112 are lowered to be withdrawn from the counting holes 111, resulting in that the four flat tablets (t) are held in the bottom part of each counting hole 111.

In the manner as described above, a flat tablet group consisting of the four different tablets, one for each of the four kinds, stacked along the vertical direction under a flat state is formed and held in each counting hole 111. Then, with the counting disk 11 rotated intermittently, the flat tablet groups are conveyed to the position where the counting disk 11 and the filling disk 21 overlap with each other, and, in this position, each flat tablet group is transferred from each counting hole 111 in the counting disk 11 into each containing hole 211 in the filling disk 21. This transferring operation is carried out as follows.

Figure 16:
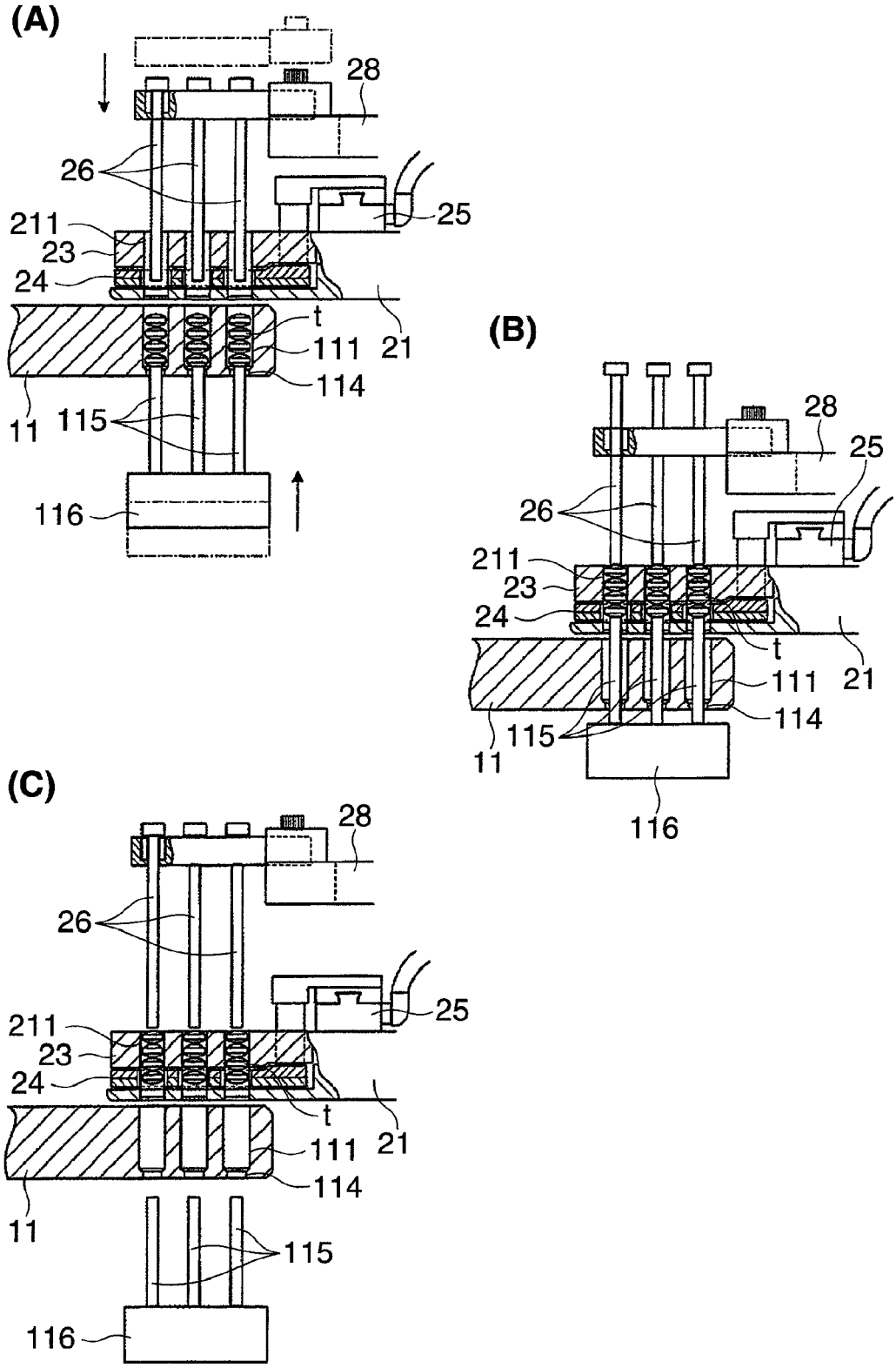
FIG. 16 illustrates operations at the time of transferring flat tablets from a counting disk to the filling disk, in the tablet filling device.

As shown in FIG. 16(A), first, the arm body 28 is lowered, whereby the supplying-time tablet presser pins 26 supported on the arm body 28 are let enter the containing holes 211 in the filling disk 21 from above, resulting in that the tips of the supplying-time tablet presser pins 26 are located at lower parts of the containing holes 211. Substantially simultaneously with this, the tablet discharge pins 115 arranged on the lower side of the counting disk 11 are moved upward to enter the counting holes 111 from below, to push up the flat tablet groups held in the counting holes 111, as shown in FIG. 16(B). Thus, the flat tablet groups are discharged upward from the counting holes 111, to be fed into the containing holes 211 in the filling disk 21 from the lower side.

In this case, the tip of each supplying-time tablet presser pin 26 having entered each containing hole 211 makes contact with the uppermost flat tablet (t) in each flat tablet group, and the supplying-time tablet presser pin 26 presses the flat tablet group from above by its own weight. In this condition, each flat tablet group is fed into each containing hole 221 while pushing up each supplying-time tablet presser pin 26, and, when the lowermost flat tablet in each flat tablet group reaches the arrangement position of the tablet holding member 24, the lowermost tablet is pinched by the tablet holding member 24, whereby each flat tablet group is held in each containing hole 211.

Figure 17:
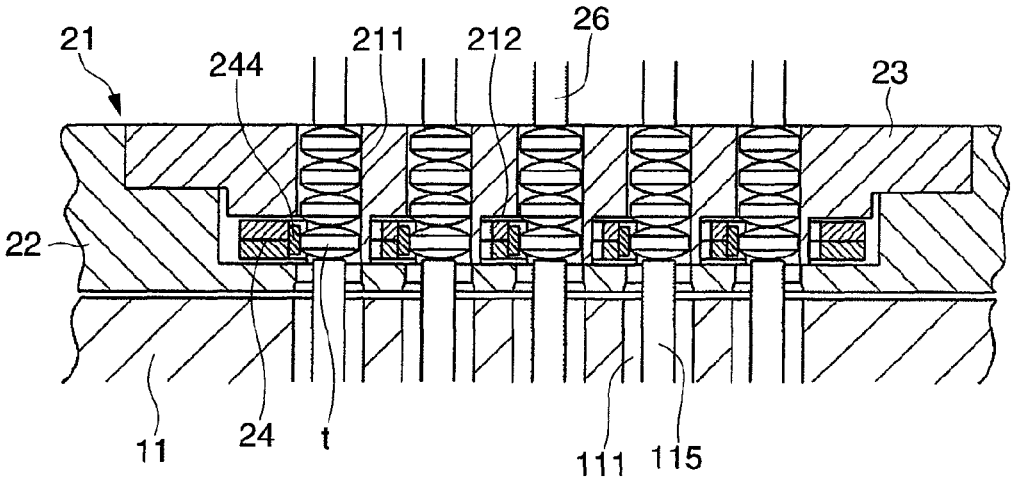
FIG. 17 shows enlarged sectional views for illustrating operations at the time of transferring the flat tablets from the counting disk to the filling disk, in the tablet filling device.
Figure 17:
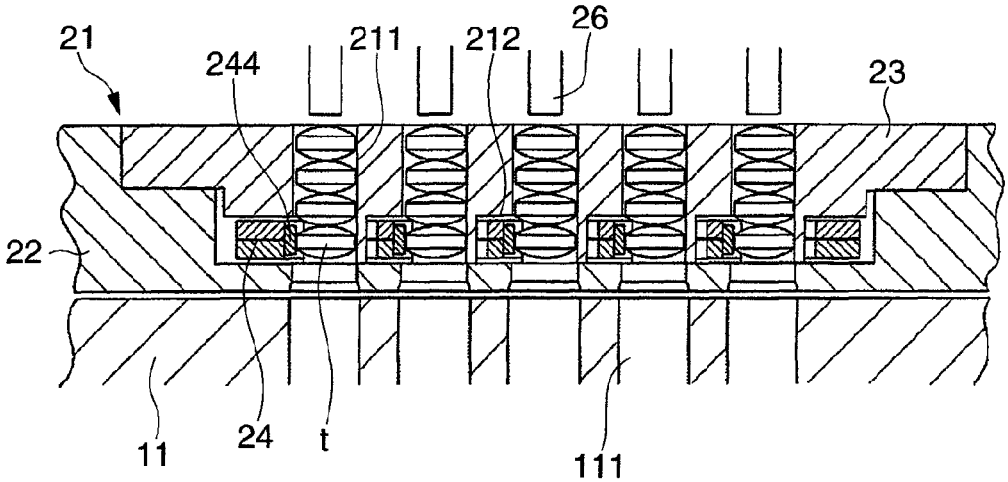

Specifically, as shown in FIG. 17(A), when the lowermost tablet (t) in the flat tablet group fed into each containing hole 211 by each tablet discharge pin 115 reaches the arrangement position of the tablet holding member 24, the air cylinder 25 (see FIG. 9 and the like) is operated to slide the tablet holding member 24 in one direction, and each pinching section 244 of the tablet holding member 24 enters each containing hole 211 by way of each through-hole window 212. The pinching section 244 presses a circumferential edge part of the lowermost flat tablet (t) in a horizontal direction, whereby the circumferential edge part of the lowermost flat tablet (t) is pinched between the pinching section 244 and the inner circumferential surface of the containing hole 211, and each flat tablet group is thereby held in each containing hole 211.

In this condition, as shown in FIGS. 16(C) and 17(B), the tablet discharge pins 115 are lowered to be withdrawn from the counting holes 111, and the arm body 28 is moved upward, whereby the tip of each supplying-time tablet presser pin 26 is separated from the uppermost tablet in each flat tablet group. Then, the filling disk 21 and the counting disk 11 are rotated intermittently, whereby the flat tablet groups held in the containing holes 211 are conveyed to the position of overlapping with the body disk 32, and the flat tablets are again fed into the counting holes 111 by the fixed-number-of-tablets supplying units 12*a* to 12*d*.

Each flat tablet group conveyed onto the body disk 32 while being held in the containing hole 211 is dropped into each capsule body (m) held in each body holding hole 321 in the body disk 32, to fill the capsule body (m). The operations in this case are as follows.

In the overlapping area of the filling disk 21 and the body disk 32, as shown in FIG. 8, both the disks 21 and 32 are intermittently stopped in the condition where the containing holes 211 and the body holding holes 321 are coinciding and communicating with each other. In this condition, as shown in FIG. 18(A), first, the body holding pins 322 arranged under the body disk 32 are moved upward to enter the body holding holes 321 from below, and push up the capsule bodies (m) in the body holding holes 321, resulting in that the upper end opening parts of the capsule bodies (m) are substantially flush with the upper surface of the body disk 32.

Figure 18:
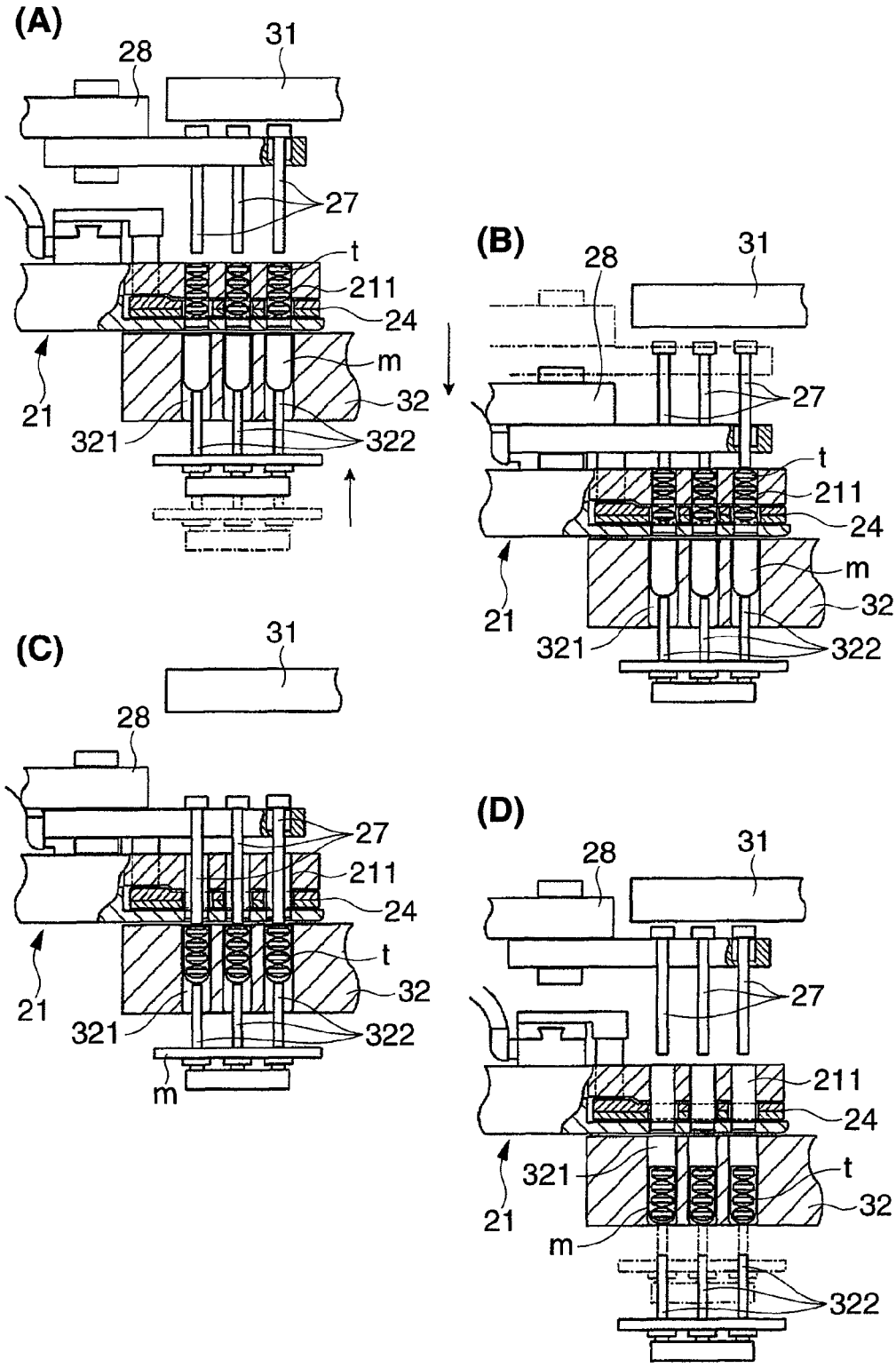
FIG. 18 shows illustrations for illustrating operations at the time of filling capsule bodies with the flat tablets from containing holes in the filling disk, in the tablet filling device.
Figure 19:
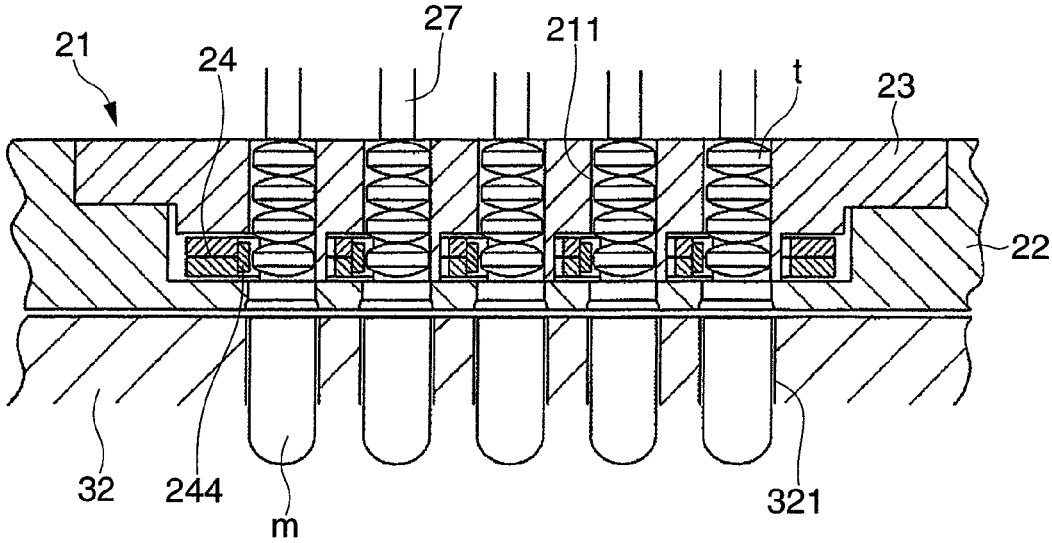
FIG. 19 shows enlarged sectional views for illustrating operations at the time of filling the capsule bodies with the flat tablets from the containing holes in the filling disk, in the tablet filling device.
Figure 19:
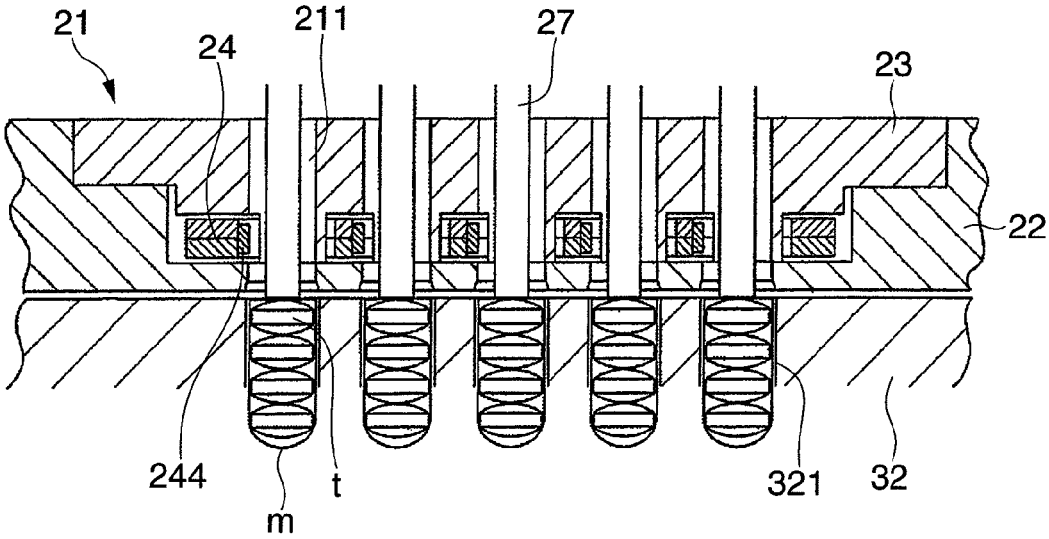

Substantially simultaneously with this, as shown in FIG. 18(B), the arm body 28 is lowered, the filling-time tablet presser pins 27 supported on the arm body 28 are lowered, and the tip of each filling-time tablet presser pin 27 comes into contact with the uppermost tablet (t) in the flat tablet group held in each containing hole 211, resulting in that each flat tablet group is pressed from above by the weight of the filling-time tablet presser pin 27 itself. Specifically, as shown in FIG. 19(A), each filling-time tablet presser pin 27 makes contact with the uppermost tablet (t) in each flat tablet group contained and held in each containing hole 211 in the filling disk 21, and the flat tablet group is pressed from above by the weight of the filling-time tablet presser pin 27 itself. In this condition, each lowermost tablet (t) is pinched by the pinching section 244 of each tablet holding member 24, so that the flat tablet group is held in each containing hole 211.

In this condition, the air cylinder 25 is operated to slide the tablet holding members 24 in the reverse direction, whereby the pinching section 244 of each tablet holding member 24 is withdrawn from each containing hole 211, and the pinching of each lowermost flat tablet (t) is released. Consequently, as shown in FIGS. 18(C) and 19(B), the flat tablet group in each containing hole 211 is dropped into each capsule body (m) disposed directly below. In this case, each filling-time tablet presser pin 27 also falls together with the flat tablet group under its own weight, so that the flat tablet group falls downward while being pressed from above by the filling-time tablet presser pin 27, to be dropped into the capsule body (m) below.

Then, as shown in FIG. 18(D), the body holding pins 322 are lowered to withdraw from the body holding holes 321, and the arm body 28 is moved upward, whereby the filling-time tablet presser pins 27 are lifted up, to be withdrawn from the containing holes 211.

Next, each capsule body held in the body holding hole 321 and filled with the tablets is conveyed by the intermittent rotation of the body disk 32, and is coupled with the cap at the capsule coupling unit 36 (see FIG. 2) of the capsule separating/coupling unit 3, to produce a capsulated drum, which is discharged through the discharge chute 37 (see FIGS. 1 and 2) to the exterior of the device, to be recovered. In addition, each of the emptied containing holes 211 is again supplied with the flat tablet group from the counting disk 11.

Thereafter, the series of operations as above-mentioned are repeated continuously, whereby the capsulated drug filled with the four kinds of flat tablets under the flat stacked state can be produced automatically.

Figure 20:
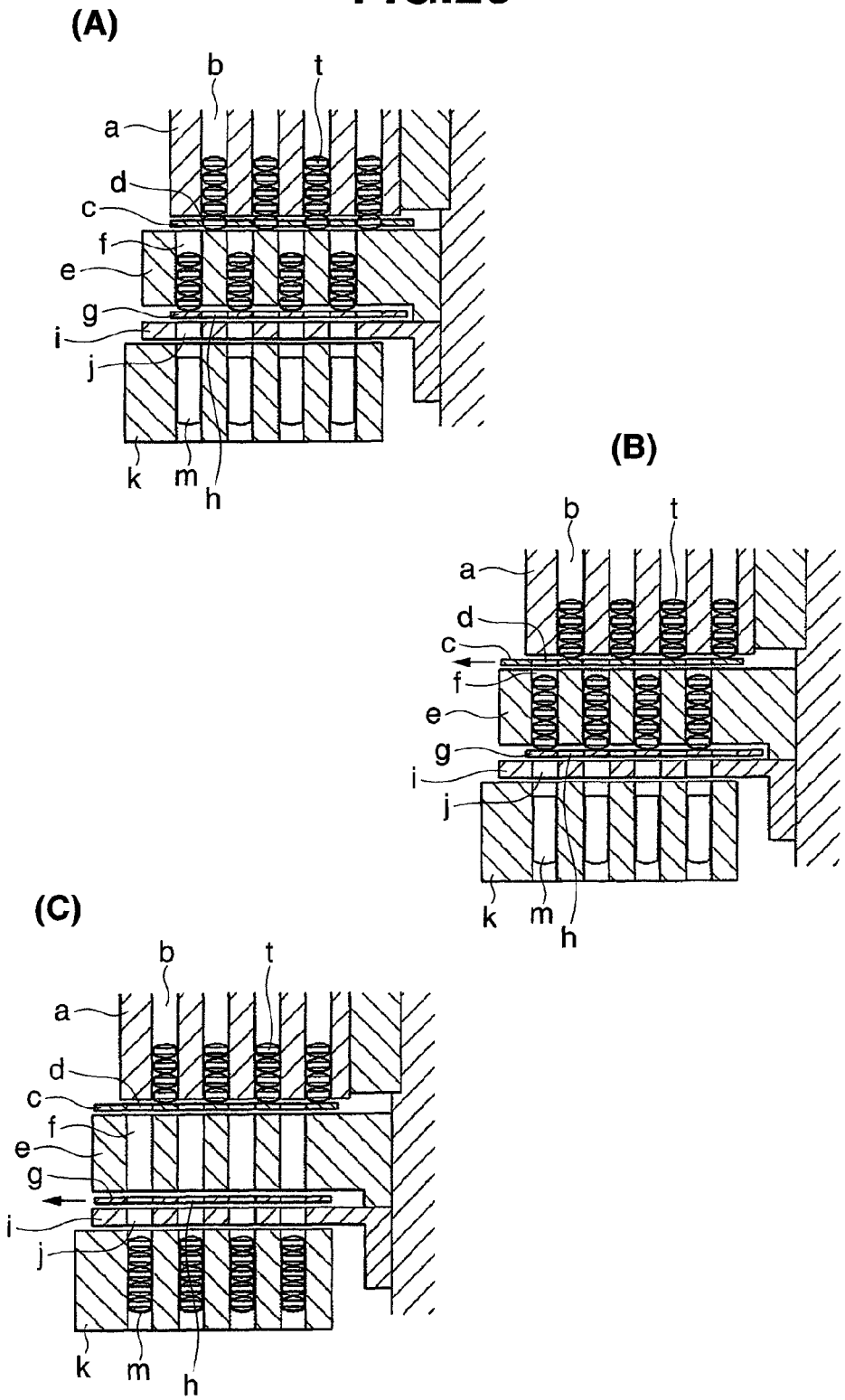
FIG. 20 shows illustrations for illustrating a filling operation in a tablet filling apparatus according to the related art.

As has been described above, in the device for filling capsule with tablet according to the present embodiment, each flat tablet group including four flat tablets (t) under a flat stacked state is held in each containing hole 211 by pinching the circumferential part of the tablet at the lowermost position in the flat tablet group by the pinching section 244 of each tablet holding member 24 (tablet holding means) arranged at the lower end part of each containing hole 211, and the pinching of the circumferential edge part of the lowermost tablet by the tablet holding member 24 is released to thereby drop each flat tablet group into each capsule body (m). Therefore, instead of the opening operation in which the lower ends of hole-shaped containing parts (f) with the flat tablets (t) contained therein are gradually opened from one lateral side as in the case of the relate-art apparatus shown in FIG. 20 where the lower ends of the containing parts (f) are opened and closed with the shutter plate (g) capable of sliding motions, in the device according to this embodiment the pinching state of the flat tablets (t) held by pinching of the circumferential edge parts thereof is released at a stroke, whereby the holding state of the flat tablets is released. Therefore, not any rotating force is exerted on the tablet (t) at the lowermost position, and not any rotating force due to friction as that at the time of opening/closing the shutter plate is exerted on the tablet (t). Consequently, the holding of the flat tablets (t) can be securely released while keeping the flat tablets (t) under a flat state, and the flat tablets (t) can be thereby dropped into the capsule body (m).

Besides, in this embodiment, at the time of dropping the flat tablet groups held in the containing holes 211 into the capsule bodies (m), each of the filling-time tablet presser pins 27 arranged to be vertically movable is brought into contact with the tablet (t) at the uppermost position in the flat tablet group from above, and, while pressing the flat tablet group from above with a predetermined force by the filling-time tablet presser pin 27, the flat tablet group is dropped into the capsule body (m) together with the filling-time tablet presser pin 27. Therefore, the flat tablet group falling from the containing hole 211 into the capsule body (m) below is dropped into the capsule body (m) while being pressed from above by the filling-time tablet presser pin 27. Thus, the flat tablet group is dropped into the capsule body (m) while the flat state of each of the flat tablets (t) constituting the flat tablet group is favorably maintained by the filling-time tablet presser pin 27. Accordingly, even if a circumferential edge part of the flat tablet (t) makes contact with the inner circumferential surface of the containing hole 211 or with the upper end edge of the capsule body (m) at the time of falling, the capsule body (m) can be filled with the flat tablet group while favorably keeping the flat state of each flat tablet (t). Thus, each capsule body (m) can be securely filled with a predetermined number of flat tablets (t), without generating any flat tablet (t) that is under a standing state.

Further, at the time of transferring the flat tablet groups from the counting disk 11 to the filling disk 21, the flat tablet groups are transferred by lifting them up from the counting holes 111 in the counting disk 11 arranged on the lower side into the containing holes 211 in the filling disk 21 arranged on the upper side. In this instance, besides, the flat tablet groups are lifted upward while pressing them from above by the supplying-time tablet presser pins 26. Accordingly, at the time of transferring the flat tablet groups from the counting disk 11 to the filling disk 22, also, the flat tablets (t) are prevented as securely as possible from coming into a standing state.

Furthermore, at the time of supplying the flat tablets (t) from each of the fixed-number-of-tablets supplying units 12*a* to 12*d* into the counting holes 111 in the counting disk 11, also, the flat tablets (t) are each received by the tip of each tablet holding pin 112 entering each counting hole 111 from below or by the preceding tablet(s) supported on the tablet holding pin 112 at the entrance of the counting hole 111 and under a flat state, and the flat tablets (t) are contained in the counting holes 111 by the lowering of the tablet holding pins 112. Therefore, at the time of supplying the flat tablets (t) into the counting holes 111, also, the generation of any flat tablet being under a standing state can be prevented as securely as possible.

Thus, according to the filling device in this embodiment, each capsule body can be securely filled with a predetermined number of flat tablets (t) under a flat state, and the capsulated drug filled with tablets can be favorably produced while preventing as securely as possible the occurrence of the inconvenience due to a flat tablet or tablets under a standing state.

Incidentally, the present invention is not to be limited to the above-described embodiment, and various modifications in the configurations of component parts are possible within the scope of the invention. For example, while the rising height of the tablet holding pins 112 has been changed by changing the rising width of the same in the above embodiment as described referring to FIGS. 12 to 15, there may be adopted a configuration in which the length of the tablet holding pins 112 is changed according to the arrangement positions of the fixed-number-of-tablets supplying units 12*a* to 12*d* and the rising width is constant. In addition, the capsule separating/coupling unit 3 may be any mechanism insofar as it ensures that the separated capsule bodies (m) can be arranged at positions just under the containing holes 211 in the filling disk 21. In other words, other mechanisms than the above-mentioned mechanism using the three feeding drums 331 to 333, the cap disk 31 and the body disk 32 may also be adopted, by appropriately selecting from among the known capsule separating/coupling mechanisms. Further, while the four fixed-number-of-tablets supplying units 12*a* to 12*d* are provided and each capsule body is supplied with a total of four different flat tablets, one for each of the four kinds, by supplying one tablet each from each of the fixed-number-of-tablets supplying units 12*a* to 12*d* in the above embodiment, the number of the fixed-number-of-tablets supplying units and the number of the tablet(s) supplied from each fixed-number-of-tablets supplying unit can be set as required. For example, a configuration may be adopted in which the reciprocating operation of the transfer plate 143 at one fixed-number-of-tablets supplying unit is repeated a predetermined number of times so as to supply the predetermined number of flat tablets, and the predetermined number of flat tablets of the same kind are counted and contained into the counting disk 111. Furthermore, other configurations may also be modified variously within the scope of the present invention.

The invention claimed is:

1. A method for filling capsule body with tablet, by which a predetermined number of flat tablets aligned and stacked along the vertical direction while being each kept under a flat state are dropped into a capsule body arranged below so as to fill said capsule body with said predetermined number of flat tablets, wherein said predetermined number of flat tablets under a flat state are contained in a containing hole with their axes set along the vertical direction, in the state of being stacked coaxially, and a circumferential edge part of said flat tablet at a lowermost position is supported by tablet holding means disposed at a lower end part of said containing hole, whereby said flat tablets are contained in said containing hole in said flat stacked state, then, in this condition, said capsule body is arranged just under said containing hole and the supporting of said lowermost-position tablet by said tablet holding means is released, whereby a flat tablet group including said plurality of flat tablets stacked under the flat state is dropped from said containing hole into said capsule body, wherein said tablet holding means comprises a through-window formed in a part of a circumferential surface of a lower end part of said containing hole, and a tablet holding member having a pinching part and inserted in said through-window so as to face to the inside of said containing hole, and said circumferential edge part of said lowermost-position tablet in said flat tablet group is pressed in a horizontal direction by said pinching part of said tablet holding member so as to pinch said tablet circumferential edge part between said pinching part and an inner circumferential surface of said containing hole, thereby holding said flat tablet group in said containing hole, and wherein a slide drive source for horizontally sliding the tablet holding member is provided, and the tablet holding member is horizontally slid by the slide drive source so that a circumferential edge part of the lowermost-position tablet in said flat tablet group in the containing hole is pressed in a horizontal direction by the pinching part of said tablet holding member so as to pinch said tablet circumferential edge part between said pinching part and an inner circumferential surface of the containing hole, whereby each flat tablet group is dropped downward from a lower end surface of each containing hole into each capsule body arranged just under each containing hole, and the pinching of said lowermost-position tablet in said flat tablet group is released by horizontally sliding said tablet holding member in a reverse direction by said slide drive source.

2. The method for filling capsule body with tablet as set forth in claim 1, wherein a filling-time tablet presser pin is brought from above into contact with the uppermost-position tablet in said flat tablet group contained in said containing hole so as to press said flat tablet group downward with a predetermined force, then, in this condition, the supporting of said lowermost-position tablet by said tablet holding means is released so that said flat tablet group drops together with said filling-time tablet presser pin and that said flat tablet group drops into said capsule body while being pressed from above by said filling-time tablet presser pin, whereby said capsule body is filled with said flat tablets while the flat state of each of said flat tablets constituting said flat tablet group is kept by said presser pin.

3. The method for filling capsule body with tablet as set forth in claim 2, wherein said filling-time tablet presser pin is arranged just over said containing hole in the state of being movable along the vertical direction, and said flat tablet group is pressed from above by the weight of said filling-time tablet presser pin itself, whereby said flat tablet group is let drop together with said filling-time tablet presser pin in a free-fall mode and said flat tablet group thus drops into said capsule body.

4. The method for filling capsule body with tablet as set forth in claim 1, wherein the slide drive source is an air cylinder.

5. A device for filling capsule with tablet, by which a predetermined number of flat tablets are aligned and stacked along the vertical direction while being each kept under a flat state and a capsule body is filled with said predetermined number of flat tablets fed into said capsule body, wherein said device comprises:

a containing hole having an axis along the vertical direction and operative to contain a flat tablet group which includes said predetermined number of flat tablets stacked along the vertical direction while being each kept under a flat state;

a tablet supplying mechanism unit for supplying said predetermined number of flat tablets into said containing hole so as to form said flat tablet group in said containing hole;

tablet holding means for supporting a circumferential edge part of the lowermost-position tablet so as to hold said flat tablet group in said containing hole; and a capsule body arranging mechanism unit for arranging said capsule body just under said containing hole;

wherein the supporting of said lowermost-position tablet in said flat tablet group by said tablet holding means is released, thereby dropping said flat tablet group from said containing hole into said capsule body, wherein said tablet holding means comprises a through-window formed in a part of a circumferential surface of a lower end part of said containing hole, and a tablet holding member having a pinching part and inserted in said through-window so as to face to the inside of said containing hole, and said circumferential edge part of said lowermost-position tablet in said flat tablet group is pressed in a horizontal direction by said pinching part of said tablet holding member so as to pinch said tablet circumferential edge part between said pinching part and an inner circumferential surface of said containing hole, thereby holding said flat tablet group in said containing hole, and wherein a slide drive source for horizontally sliding the tablet holding member is further provided, and the tablet holding member is horizontally slid by the slide drive source so that a circumferential edge part of the lowermost-position tablet in said flat tablet group in the containing hole is pressed in a horizontal direction by the pinching part of said tablet holding member so as to pinch said tablet circumferential edge part between said pinching part and an inner circumferential surface of the containing hole, whereby each flat tablet group is dropped downward from a lower end surface of each containing hole into each capsule body arranged just under each containing hole, and the pinching of said lowermost position tablet in said flat tablet group is released by horizontally sliding said tablet holding member in a reverse direction by said slide drive source.

6. The device for filling capsule with tablet as set forth in claim 5, wherein said device comprises a filling disk having a plurality of hole sections each comprising a containing hole group comprising a plurality of said containing holes in alignment, the filling disk being intermittently roatable, said flat tablets are supplied from said tablet supplying mechanism unit to be contained into each of said containing holes in said containing hole section of said filling disk at a predetermined rotational angle position, said flat tablets in this state are fed to a predetermined position by rotating said filling disk, and, at a predetermined rotational angle position of said filling disk, said flat tablet group in each containing hole in said containing hole section is dropped into said capsule body arranged just under each containing hole by said capsule body arranging mechanism unit.

7. The device for filling capsule with tablet as set forth in claim 5, wherein said device comprises a filling-time tablet presser pin which enters said containing hole from above to come into contact with the uppermost-position tablet in said flat tablet group contained in said containing hole, presses said flat tablet group downwards with a predetermined pressure, and falls together with said flat tablet group when said flat tablet group is dropped into said capsule body.

8. The device for filling capsule body with tablet as set forth in claim 5, wherein the slide drive source is an air cylinder.

9. A device for filling capsule with tablet, by which a predetermined number of flat tablets are aligned and stacked along the vertical direction while being each kept under a flat state and a capsule body is filled with said predetermined number of flat tablets fed into said capsule body, wherein said device comprises:

a containing hole having an axis along the vertical direction and operative to contain a flat tablet group which includes said predetermined number of flat tablets stacked along the vertical direction while being each kept under a flat state;

a tablet supplying mechanism unit for supplying said predetermined number of flat tablets into said containing hole so as to form said flat tablet group in said containing hole;

tablet holding means for supporting a circumferential edge part of the lowermost-position tablet so as to hold said flat tablet group in said containing hole;

a capsule body arranging mechanism unit for arranging said capsule body just under said containing hole; and a filling disk having a plurality of hole sections each comprising a containing hole group comprising a plurality of said containing holes in alignment, the filling disk being intermittently roatable, wherein the supporting of said lowermost-position tablet in said flat tablet group by said tablet holding means is released, thereby dropping said flat tablet group from said containing hole into said capsule body, wherein said flat tablets are supplied from said tablet supplying mechanism unit to be contained into each of said containing holes in said containing hole section of said filling disk at a predetermined rotational angle position, said flat tablets in this state are fed to a predetermined position by rotating said filling disk, and, at a predetermined rotational angle position of said filling disk, said flat tablet group in each containing hole in said containing hole section is dropped into said capsule body arranged just under each containing hole by said capsule body arranging mechanism unit, and wherein said filling disk comprises:

a circular plate-shaped disk body that is rotated intermittently;

a containing hole forming member which is a plate-shaped or block-shaped member provided with a plurality of through-holes, is firmly fitted in a containing hole section forming recess provided in an upper surface of a circumferential edge part of said disk body, and has said through-holes brought into communication with a plurality of through-holes provided in said containing hole section forming recess, thereby forming said containing holes;

a tablet holding member which is a thin plate-shaped member provided with a plurality of pinching holes slightly larger than said containing holes in diameter, is slidably disposed between said containing hole forming member and a bottom surface of said containing hole section forming recess, and is so disposed that said pinching holes surround said containing holes, with a part of an inner circumferential edge part of each pinching hole being a pinching part that is inserted into a through-window formed in a lower end part of each containing hole, so as to front on the inside of each containing hole; and a slide drive source for putting said tablet holding member into sliding motions so as to cause said pinching part of each pinching hole to enter and withdraw from said containing hole through said through-window, and wherein said pinching part is caused to enter said containing hole through said through-window by sliding said tablet holding member by said slide drive source so that a circumferential edge part of the lowermost-position tablet in said flat tablet group contained in each containing hole is pressed in a horizontal direction by said pinching part and that said tablet circumferential edge part is pinched between said pinching part and an inner circumferential surface of each containing hole, whereby each flat tablet group is held in each containing hole, and, on the other hand, the pinching of said lowermost-position tablet in each flat tablet group is released by sliding said tablet holding member in a reverse direction by said slide drive source, whereby each flat tablet group is dropped downward from a lower end surface of each containing hole into each capsule body arranged just under each containing hole.

10. A device for filling capsule with tablet, by which a predetermined number of flat tablets are aligned and stacked along the vertical direction while being each kept under a flat state and a capsule body is filled with said predetermined number of flat tablets fed into said capsule body, wherein said device comprises:

a containing hole having an axis along the vertical direction and operative to contain a flat tablet group which includes said predetermined number of flat tablets stacked along the vertical direction while being each kept under a flat state;

a tablet supplying mechanism unit for supplying said predetermined number of flat tablets into said containing hole so as to form said flat tablet group in said containing hole;

tablet holding means for supporting a circumferential edge part of the lowermost-position tablet so as to hold said flat tablet group in said containing hole; and a capsule body arranging mechanism unit for arranging said capsule body just under said containing hole, wherein the supporting of said lowermost-position tablet in said flat tablet group by said tablet holding means is released, thereby dropping said flat tablet group from said containing hole into said capsule body, wherein said tablet supplying mechanism unit comprises:

a counting disk which is provided with counting holes for each containing a predetermined number of said flat tablets, is so disposed as to have a part of an upper surface thereof located close to a lower end surface of each containing hole, and is rotated intermittently;

one or a plurality of fixed-number-of-tablets supplying units disposed in contact with or in proximity to said upper surface of said counting disk; and tablet discharge pins that enter said counting holes from below through through-holes formed in bottom walls of said counting holes so as to push out upward said flat tablets contained in said counting holes, and wherein a predetermined number of flat tablets are fed from each fixed-number-of-tablet supplying units into each counting hole in said counting disk while being each kept in a flat state, so as to form in each counting hole a flat tablet group comprised of said predetermined number of flat tablets stacked in a flat state, said flat tablet groups in this condition are fed to positions just under said containing holes by intermittent rotation of said counting disk, and said tablet discharge pins arc let enter said counting holes so as to push out said flat tablet groups upward from said counting holes and to feed said flat tablet groups into said containing holes from below, whereby said predetermined number of flat tablets are supplied into each containing hole in the state of said flat tablet group in which said flat tablets are stacked in a flat state.

11. The device for filling capsule with tablet as set forth in claim 10, wherein said device comprises supplying-time tablet presser pins which are vertically movably arranged just over said containing holes at a tablet supplying position for feeding said flat tablet groups from said counting holes into said containing holes, each come into contact with the uppermost-position tablet in each flat tablet group fed from each counting hole into each containing hole, so as to press said flat tablet group from above with a predetermined pressure, and, in this condition, each move upward together with each flat tablet group fed from each counting hole into each containing hole.

12. The device for filling capsule with tablet as set forth in claim 10 or 11, wherein said device comprises vertically movable tablet holding pins which are each arranged correspondingly to the position of supplying said tablet from each fixed-number-of-tablets supplying unit into each counting hole, and each enter each counting hole from below through said through-hole in said bottom wall of each counting hole, so as to support said flat tablets fed from said fixed-number-of-tablets supplying unit into each counting hole, and wherein said flat tablet fed from each fixed-number-of-tablets supplying unit into each counting hole is received at an upper end part of said counting hole by said tablet holding pin or by the preceding tablet supported by said tablet holding pin.

* * * * *